US007172807B2

(12) United States Patent
Fukano et al.

(10) Patent No.: US 7,172,807 B2
(45) Date of Patent: Feb. 6, 2007

(54) SURFACE-COATED MEMBER

(75) Inventors: Tsuyoshi Fukano, Sendai (JP); Keiji Usami, Sendai (JP); Hiroki Ishii, Sendai (JP); Takahito Tanibuchi, Sendai (JP)

(73) Assignee: Kyocera Corporation, Kyoto (JP)

( * ) Notice: Subject to any disclaimer, the term of this patent is extended or adjusted under 35 U.S.C. 154(b) by 341 days.

(21) Appl. No.: 10/780,527

(22) Filed: Feb. 17, 2004

(65) Prior Publication Data

US 2004/0161639 A1 Aug. 19, 2004

(30) Foreign Application Priority Data

| | | |
|---|---|---|
| Feb. 17, 2003 | (JP) | 2003-037556 |
| Mar. 26, 2003 | (JP) | 2003-086066 |
| Sep. 26, 2003 | (JP) | 2003-336315 |
| Nov. 27, 2003 | (JP) | 2003-397311 |
| Dec. 25, 2003 | (JP) | 2003-431557 |
| Jan. 29, 2004 | (JP) | 2004-022289 |
| Jan. 29, 2004 | (JP) | 2004-022290 |

(51) Int. Cl.
*B23B 27/00* (2006.01)

(52) U.S. Cl. ..... 428/216; 51/307; 51/309; 428/325; 428/472; 428/698; 428/701; 428/702

(58) Field of Classification Search ..... 428/325, 428/698, 701, 212, 697, 699, 216, 702, 472; 51/307, 309

See application file for complete search history.

(56) References Cited

U.S. PATENT DOCUMENTS 5,652,045 A * 7/1997 Nakamura et al. ..... 428/698
6,251,508 B1 * 6/2001 Ruppi ..... 428/325

FOREIGN PATENT DOCUMENTS

| | | |
|---|---|---|
| JP | 08-001408 | 1/1996 |
| JP | 08-187605 | 7/1996 |
| JP | 09-174304 | 7/1997 |
| JP | 10-109206 | 4/1998 |
| JP | 11-269650 | 10/1999 |
| JP | 2000-158205 | 6/2000 |

* cited by examiner

*Primary Examiner*—Archene Turner
(74) *Attorney, Agent, or Firm*—Hogan & Hartson LLP

(57) ABSTRACT

The surface-coated member 1 is constituted by coating the surface of the base body 2, made of such a material as cemented carbide or cermet, with the hard coating layer 3 that comprises at least one TiCN layer 4 and the $Al_2O_3$ layer 6 formed on the surface of the TiCN layer 4, wherein the TiCN layer 4 is constituted from stringer-like TiCN crystal grown in a direction perpendicular to the base body 2 and mean crystal width $w_1$ of the TiCN layer 4 on the $Al_2O_3$ layer 6 side is made larger than mean crystal width $w_2$ on the base body 2 side. This surface-coated member, as a cutting tool, shows excellent breakage resistance and high wear resistance with a long service life, where strong adhesion force of the hard coating layer can be maintained without experiencing peel-off between the TiCN layer and the $Al_2O_3$ layer even in cutting operations under harsh cutting conditions, such as intermittent cutting operation where the cutting edge is subject to strong impact.

28 Claims, 10 Drawing Sheets

39

26

24(32)

25

SURFACE-COATED MEMBER

Priority is claimed to Japanese Patent Application No. 2003-37556, filed on Feb. 17, 2003, No. 2003-86066, filed on Mar. 26, 2003, No. 2003-336315, filed on Sep. 26, 2003, No. 2003-397311, filed on Nov. 27, 2003, No. 2003-431557, filed on Dec. 25, 2003, No. 2004-22289, filed on Jan. 29, 2004, and No. 2004-22290, filed on Jan. 29, 2004, the disclosure of which is incorporated by reference in its entirety.

BACKGROUND OF THE INVENTION

1. Field of the Invention

The present invention relates to a surface-coated member such as a surface-coated cutting tool that is coated with a hard coating layer having excellent chipping resistance and high wear resistance, and particularly to a surface-coated cutting tool that shows high breakage (fracture) resistance and high cutting performance under harsh cutting conditions.

2. Description of Related Art

A common type of cutting tool used widely in metal cutting operations is the surface-coated cutting tool that comprises a base body made of cemented carbide, cermet, ceramic or the like that is coated with one or more hard coating layer such as TiC layer, TiN layer, $Al_2O_3$ layer or TiCN layer formed on the surface thereof.

As high efficiency cutting operations become commonplace, conventional cutting tools experience such problems as the hard coating layer cannot endure strong impact generated in cutting operations where the cutting edge receives strong impact such as heavy intermittent cutting of metal, eventually resulting in chipping of the rake surface or peel-off of the hard coating layer. Thus service life of the cutting tool is limited by sudden occurrence of tool breakage such as breakage or abnormal wear of the cutting edge.

Japanese Patent No. 3230372 described that breakage resistance of a cutting tool can be improved by forming the hard coating layer where TiCN layer that includes columnar crystal is divided by a granular TiN layer or the like thereby to suppress peel-off of layers.

However, the constitution disclosed in Japanese Patent No. 3230372 cannot solve the problem that the hard coating layer is liable to peel-off near the interface between the $Al_2O_3$ layer and the TiCN layer. Thus cutting operations where the cutting edge receives strong impact such as heavy intermittent cutting of metal have still been prone to chipping and/or peel-off of the hard coating layer in the interface between the $Al_2O_3$ layer and the TiCN layer. In case thickness of the hard coating layer is decreased for the purpose of preventing chipping and peel-off of the hard coating layer, the hard coating layer disappears prematurely, resulting in accelerated wear and failure to extend tool life of the cutting tool.

In case attention is directed only to the adhesion force between the $Al_2O_3$ layer and the TiCN layer, adhesion force between the TiCN layer and the base body is compromised, thus leading to peel-off from the TiCN layer and failure to elongate the service life of the cutting tool.

Japanese Unexamined Patent Publication No. 2000-158205 discloses such a constitution as the proportions of carbon C and nitrogen N contents in the TiCN layer made of stringer-like TiCN crystal (longitudinally grown TiCN crystal) are varied, with the upper layer ($Al_2O_3$ layer) side made of TiCN having higher nitrogen content and the lower layer (base body) side made of TiCN having higher carbon content, so that occurrence of chipping is reduced during high-speed cutting operations.

However, in case castings such as gray cast iron (FC) or ductile cast iron (FCD), or steel having inhomogeneity in hardness or unusual shape is cut, sporadic application of strong impact to the cutting edge of the tool causes the coating layer including the TiCN layer to peel off, thus exposing the base body and rapid progress of wear. Moreover, when thickness of the layer involves variability among individual tools, thinner $Al_2O_3$ layer leads to plastic deformation due to lower wear resistance. Thicker $Al_2O_3$ layer, on the other hand, causes the coating layer including the TiCN layer to peel off, thus exposing the base body and resulting in rapid progress of wear. Such variability in the performance related to the film thickness has been conspicuous.

Japanese Patent No. 3269305 disclosed such a process that, after a titanium-based hard layer including a TiCN layer has been formed, heat treatment is carried out in hydrogen atmosphere of 10 to 100 torr at a temperature from 850 to 1100° C. for a duration of one to five hours, so that W and Co are diffused in the grain boundary of TiCN crystal, thereby to improve bonding between the titanium-based hard layer and the aluminum oxide layer of the hard coating layer.

With the constitution described in Japanese Patent No. 3269305, however, the cutting edge is still subject to abnormal wear due to chipping, thus resulting in short service life of the cutting tool under harsh cutting conditions which are often employed recently such as heavy intermittent cutting where the cutting edge is subject to sudden application of strong impact. In case thickness of the hard coating layer is decreased for the purpose of preventing chipping and or peel-off of the hard coating layer, the hard coating layer disappears prematurely, resulting in accelerated wear and failure to elongate the service life of the cutting tool. Also there have been demands for further improvements in breakage resistance and in wear resistance for cutting of steel and other materials.

Japanese Unexamined Patent Publication No. 11-269650 describes that bonding between the $Al_2O_3$ layer and the TiCN layer can be improved by interposing such a $Ti_2O_3$ layer having a mean thickness of 0.1 to 2 μm between the $Al_2O_3$ layer and the TiCN layer that shows X-ray diffraction pattern having maximum diffraction peak at a diffraction angle (2θ) of 24.0±1 degrees observed in X-ray diffraction analysis using Cu-k α line as the beam source. However, titanium oxide cannot endure the high-load machining operations which are dominant recently.

Japanese Unexamined Patent Publication No. 9-174304 describes such a constitution as an intermediate layer consisting of needle-like grains as viewed in the cross section is provided between a titanium carbonitride layer and the aluminum oxide layer formed on the surface of the former, so as to restrain the aluminum oxide layer from peeling off by anchoring effect and prevent the wear resistance from decreasing.

With the constitution of interposing the intermediate layer consisting of needle-like grains between the titanium carbonitride layer and the aluminum oxide layer, however, although peel-off of the aluminum oxide layer can be prevented, it has been necessary to further improve the breakage resistance of the hard coating layer.

Japanese Unexamined Patent Publication No. 10-109206 describes that crystal width of the $Al_2O_3$ layer side in a pillar-shaped crystal TiCN layer is increased 1.0 to 1.3 times of the crystal width of the base body side, thereby suppressing membrane separation from an interface with $Al_2o_3$ layer and TiCN layer, and preventing the tool damage such as abnormal wear and sudden breakage.

According to Japanese Unexamined Patent Publication No. 10-109206, however, although the tool damage by membrane separation can be prevented, the breakage-proof nature and wear resistances of a hard covering layer itself are insufficient, and the enough tool life cannot be acquired. Therefore, the further improvement of the breakage-proof nature and wear resistance of the hard covering layer was demanded.

SUMMARY OF THE INVENTION

An advantage of the present invention is to provide a surface-coated member such as a surface-coated cutting tool of long service life that shows excellent breakage resistance and high wear resistance without chipping or peel-off in interface between the base body, TiCN layer and $Al_2O_3$ layer under harsh cutting conditions such as high-speed cutting and high feed rate cutting, or in cutting operations that require particularly wear resistance.

The inventor of the present application continued researches on the method to improve breakage resistance without compromising the wear resistance of a surface-coated member that comprises a base body and a hard coating layer consisting of the TiCN layer and the $Al_2O_3$ layer formed in this order on the surface of the base body. Through these researches, it was found that adhesion force between the base body, the TiCN layer and the $Al_2O_3$ layer can be improved by forming the TiCN layer from stringer-like TiCN crystal that is grown in a direction perpendicular to the base body and controlling the mean crystal width of the TiCN layer on the $Al_2O_3$ layer side larger than the mean crystal width on the base body side.

With this constitution, a surface-coated member that shows excellent wear resistance and high breakage resistance is obtained since strong bonding of the hard coating layer can be maintained even when the $Al_2O_3$ layer is formed with a large thickness that is required for improving the wear resistance, while occurrence of chipping and peel-off of layers near the interface between the base body, the $Al_2O_3$ layer and the TiCN layer can be avoided even in cutting operations under harsh cutting conditions where the cutting edge of the cutting tool is subject to strong impact, including heavy intermittent cutting of metal such as cast iron that contains high-hardness graphite grains scattered therein including, in particular, gray cast iron (FC) or ductile cast iron (FCD).

The surface-coated member of the present invention is constituted as described in (1a) through (1c).

(1a) The member comprises a base body comprising cemented carbide and a hard coating layer comprising at least an $Al_2O_3$ layer and a TiCN layer formed in this order on the surface of the base body.

(1b) The TiCN layer is formed from stringer-like TiCN crystal that is grown in a direction perpendicular to the base body.

(1c) The stringer-like TiCN crystal consists of at least two layers wherein the mean crystal width thereof is larger on the $Al_2O_3$ layer than on the base body side.

The surface-coated member preferably may comprise a carbon-rich TiCN layer located on top of the $Al_2O_3$ layer where ratio C/N of proportions of carbon C and nitrogen N in the TiCN layer is in a range of $1.5 \leqq C/N \leqq 4$, and a nitrogen-rich TiCN layer located below the carbon-rich TiCN layer where the ratio C/N is in a range of $0.2 \leqq C/N \leqq 0.7$ The surface-coated member may have a binding layer consisting mainly of at least titanium (Ti), aluminum (Al), tungsten (W) and cobalt (Co) formed between the $Al_2O_3$ layer and the TiCN layer. In a scratch test, the adhesion of $Al_2O_3$ layer may be 10 to 50 N.

Another surface-coated member of the present invention is constituted as described in (2a) and (2b).

(2a) The member comprises a base body and a hard coating layer comprising at least a TiCN layer and an $Al_2O_3$ layer formed in this order on the surface of the base body.

(2b) the TiCN layer, that is observed on the periphery of the base body exposed at the center of an abrasion dent on the surface observed in Calotest, includes a lower structure where crack width is small or zero, and an upper structure where crack width is larger than that of the lower structure, located on the periphery of the lower structure.

Thus distribution of wear resistance and chipping resistance in the hard coating layer can be evaluated by observing the abrasion dent generated in Calotest. In observation of the abrasion dent, residual stress generated between the $Al_2O_3$ layer and the TiCN layer is relieved as crack is generated in the upper structure described previously. As a consequence, even under harsh cutting conditions wherein the hard coating layer receives sudden strong impact, the impact can be absorbed without having such new and larger cracks occurring that cause chipping of the hard coating layer. Also because the lower structure of the TiCN layer exists where cracks are less likely to occur, cracks generated in the upper structure are impeded from growing, the TiCN layer or the entire hard coating layer are prevented from being chipped or peeling off and wear resistance of the hard coating layer as a whole is improved.

Harsh cutting conditions described above include those which cause strong impact to the cutting edge of the cutting tool including heavy intermittent cutting of metal such as cast iron that contains high-hardness graphite grains scattered therein such as gray cast iron (FC) or ductile cast iron (FCD), continuous cutting operation and composite cutting operation that combines the intermittent cutting and continuous cutting.

Further another surface-coated member of the present invention is constituted as described in (3a) through (3c).

(3a) The member comprises a base body and a hard coating layer made of at least one titanium carbonitride layer formed on the surface of the base body.

(3b) The titanium carbonitride layer shows, at least in a part thereof, stringer structure when vertical cross section is observed in which titanium carbonitride grains extend in a direction perpendicular to the surface of the base body.

(3c) The titanium carbonitride layer includes a fine grained titanium carbonitride layer that shows needle-like structure extending in random directions when observed on the surface.

This constitution achieves high toughness and high breakage resistance while maintaining high hardness and high wear resistance. When this material is used to make a cutting tool used under harsh cutting conditions where strong impact is applied to the cutting edge of the cutting tool including heavy intermittent cutting of metal such as cast iron that contains high-hardness graphite grains scattered therein such as gray cast iron (FC) or ductile cast iron (FCD), in particular, the titanium carbonitride layer can be prevented from being subjected to strong impact acting in the direction of thickness thereof. Even when fine cracks are generated in the titanium carbonitride layer, propagation of the cracks within the layer can be restrained. As a result, chipping and peel-off of the titanium carbonitride layer can be prevented and such a surface coating material for the cutting tool can be obtained that shows excellent wear resistance and high breakage resistance.

Here, when the abrasion dent in Calotest is observed, the ratio ($L_U/L$) to the radius direction length L of the above-mentioned whole titanium carbonitride layer of the radius direction length $L_U$ of the above-mentioned upper structure is 0.05–0.15 ($L=L_U+L_L$, and $L_L$ means the radius direction length of the lower structure).

DESCRIPTION OF PREFERRED EMBODIMENTS

Embodiment 1

An example of the cutting tool which is a preferred embodiment of the surface-coated member of the present invention will be described below with reference to FIG. 1 which is a photograph taken with a scanning electron microscope (SEM) showing a fracture surface including the hard coating layer and FIG. 2 which schematically shows the same.

Figure 1:
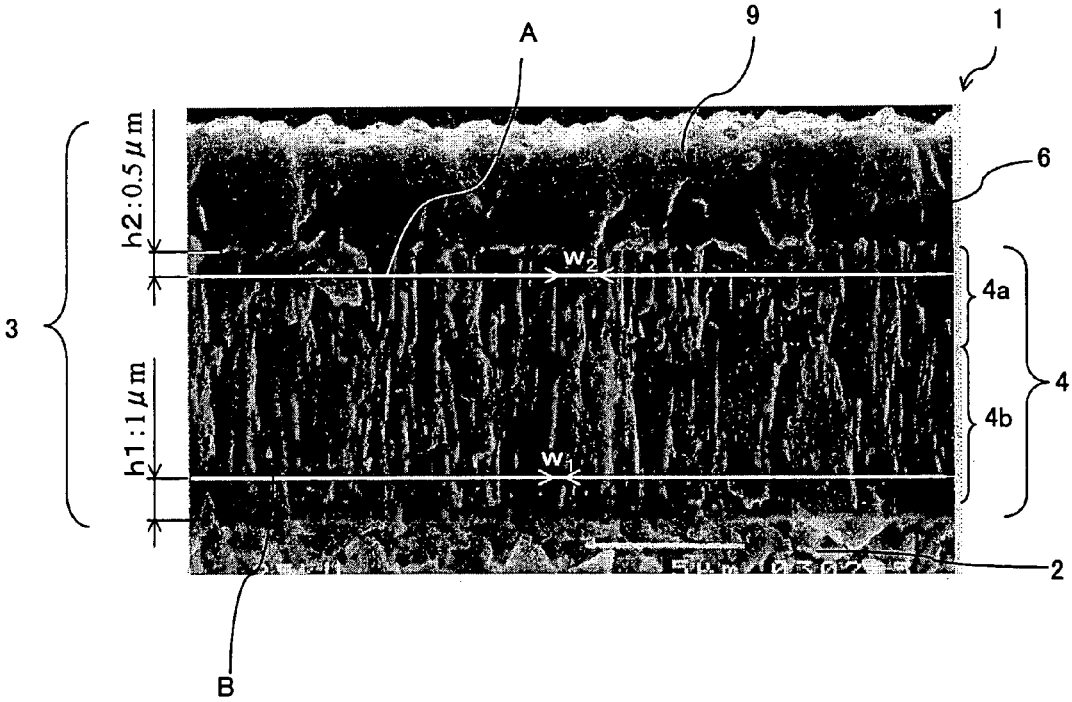
FIG. 1 is a photograph taken with a scanning electron microscope showing an example of fracture surface of surface-coated cutting tool according to the present invention.

In FIG. 1, the surface-coated cutting tool (hereinafter referred to simply as the cutting tool) 1 comprises a base body 2 and a hard coating layer 3 formed thereon. The base body 2 may be made of, for example, (i) cemented carbide consisting of carbonitride phase made of tungsten carbide (WC) and at least one kind selected from among a group of carbide, nitride and carbonitride of metals of the groups 4a, 5a and 6a of the Periodic Table that is held together by a binder phase consisting of an iron group metal such as cobalt (Co) and/or nickel (Ni); or (ii) a hard alloy such as cermet consisting mainly of titanium carbide (TiC) or titanium carbonitride (TiCN) and at least one kind selected from among a group of carbide, nitride and carbonitride of metals of the groups 4a, 5a and 6a of the Periodic Table that is held together by a binder phase consisting of an iron group metal such as cobalt (Co) and/or nickel (Ni). The base body 2 may also be made of a super hard alloy such as diamond-based sintering, cubic boron nitride (CBN)-based sintering, the ceramic sintered body which contains as a principal component a silicon nitride ($Si_3N_4$), aluminum oxide ($Al_2O_3$), or the like. Furthermore, although metals, such as steel and stainless steel, may be used, it is desirable in respect of wear resistance that the base body 2 comprises a hard metal.

The hard coating layer 3 is made in a multi-layer structure consisting of at least TiCN layer made of stringer-like TiCN crystal 8 that has grown in stringer shape in a direction perpendicular to the surface of the base body 2 (hereinafter referred to as stringer-like TiCN layer) 4 and an $Al_2O_3$ layer 6 formed successively in this order, and enables it to make a long-life cutting tool 1 having excellent wear resistance and high breakage resistance.

Unless the $Al_2O_3$ layer 6 is formed, wear resistance of the cutting tool and resistance against adhesion with the workpiece become lower. Unless the stringer-like TiCN layer 4 is formed right below the $Al_2O_3$ layer 6, breakage resistance of the hard coating layer 3 decreases.

When the stringer-like TiCN crystal 8 of the stringer-like TiCN layer 4 located right below the $Al_2O_3$ layer is made finer as a whole so as to make the mean crystal width w smaller, wear resistance is improved and adhesion force between the stringer-like TiCN layer 4 and the base body 2 is improved, thereby making it possible to suppress peel-off of the stringer-like TiCN layer 4. However, this results also in the tendency of the stringer-like TiCN layer 4 to have lower toughness, and poor bonding between the base body 2, the stringer-like TiCN layer 4 and the $Al_2O_3$ layer 6, thus increasing the possibility of the $Al_2O_3$ layer 6 to peel off from the stringer-like TiCN layer 4 and abnormal wear and breakage of the cutting edge to occur.

When the stringer-like TiCN crystal 8 of the stringer-like. TiCN layer 4 is made coarser so as to make the mean crystal width w larger, bonding between the $Al_2O_3$ layer 6 and the stringer-like TiCN layer 4 can be improved and peel-off of the $Al_2O_3$ layer 6 can be prevented. However, this results also in weaker adhesion force between the base body 2 and the stringer-like TiCN layer 4, thus making the stringer-like TiCN layer 4 more likely to peel off from the base body 2, thus again causing abnormal wear and breakage of the cutting edge.

Therefore in the cutting tool 1 of the present invention, mean crystal width $w_2$ of the stringer-like TiCN layer 4 on the $Al_2O_3$ layer 6 side (specifically at a position 0.5 μm ($h_2$ and line A) from the interface of the stringer-like TiCN layer 4 and the $Al_2O_3$ layer toward the base body 2 at right angles thereto) is made larger than the mean crystal width w, of the stringer-like TiCN layer 4 on the base body 2 side (specifically at a position 1 μm (at height $h_2$ and line B which is beyond a region of small crystal width due to nucleation) from the interface of the stringer-like TiCN layer 4 and the base body 2 toward the interface at right angles thereto). This makes it possible to improve adhesion force between the base body 2 and the stringer-like TiCN layer 4 and between the stringer-like TiCN layer 4 and the $Al_2O_3$ layer 6. Even under harsh cutting conditions that cause strong impact on the cutting edge such as heavy intermittent cutting of cast iron, in particular, occurrence of chipping and peel-off of layer near the interfaces between the base body 2, the stringer-like TiCN layer 4 and the $Al_2O_3$ layer 6 can be suppressed, thereby to maintain strong adhesion force between the layers ranging from the base body 2 to the hard coating layer 3. Thus the long-life cutting tool 1 that maintains excellent wear resistance and high breakage resistance while suppressing peel-off of layers can be obtained.

In order to improve the adhesion force with the base body 2, wear resistance and breakage resistance of the cutting tool 1 and elongate the service life, it is preferable to set the mean crystal width $w_1$ at a position of height 1 μm (line B) from the interface between the stringer-like TiCN layer 4 and the base body 2 toward the $Al_2O_3$ layer 6 in a range from 0.1 to 0.7 μm.

In order to improve the adhesion force between the $Al_2O_3$ layer and the stringer-like TiCN layer 4 and prevent wear resistance from decreasing due to layer peel-off, it is preferable to set the mean crystal width $w_2$ at a position of height 0.5 μm (line A) from the interface between the stringer-like TiCN layer 4 and the $Al_2O_3$ layer 6 toward the base body 2 in a range from 0.5 to 1.0 μm.

Figure 2:
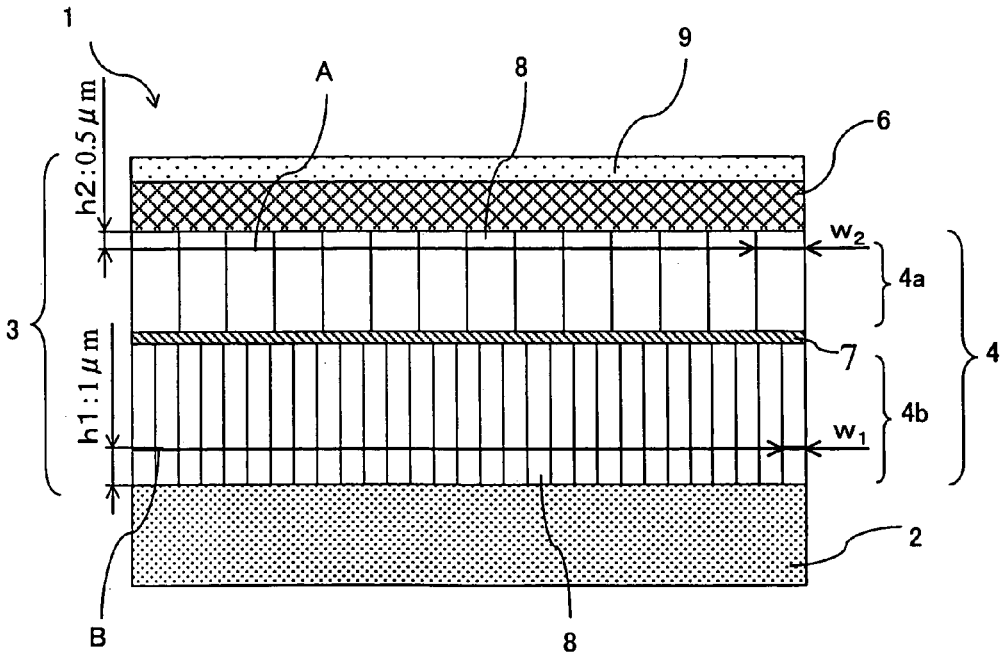
FIG. 2 is a schematic diagram of a fracture surface of the surface-coated cutting tool according to the present invention.

While the stringer-like TiCN layer 4 of the present invention may be constituted from fan-shaped crystal that has a mean crystal width w increasing continuously toward the upper layer ($Al_2O_3$ layer 6) of the stringer-like TiCN layer 4, it is preferable to constitute the stringer-like TiCN layer 4 from two layers (stringer-like TiCN layer 4*a* and stringer-like TiCN layer 4*b*) or more layers having difference values of a mean crystal width w as shown in FIG. 1 and FIG. 2. This is because the TiCN layer 4*a* having larger mean crystal width w serves as a shock absorber that constitutes a step to absorb impact so as to further improve the breakage resistance of the stringer-like TiCN layer 4 as a whole, further improve the adhesion force between the $Al_2O_3$ layer 6 and the base body 2, and facilitate the control of the mean crystal width of the stringer-like TiCN layer 4. While FIG. 1 and FIG. 2 show the stringer-like TiCN layer 4 constituted from two layers having difference values of the mean crystal width w, the present invention is not limited to this constitution and the stringer-like TiCN layer 4 may be constituted from three or more layers.

In case the stringer-like TiCN layer 4 is made in a multi-layer structure, thickness of each component layer is preferably in a range from 2 to 10 μm. Adhesion force between the base body 2, the stringer-like TiCN layer 4 and the $Al_2O_3$ layer 6 can be improved without compromising the breakage resistance by setting the ratio of thickness between the stringer-like TiCN layer 4*a* at the top and the stringer-like TiCN layer 4*b* at the bottom in a range from 1:9 to 3:7 or thickness ti of lower TiCN layer is in a range of $1\ \mu m \leqq t_1 \leqq 10\ \mu m$, and the thickness $t_u$ of upper TiCN layer is in a range of $0.5\ \mu m \leqq t_u \leqq 5\ \mu m$ while two values of thickness satisfy an inequality $1 < t_1/t_u \leqq 5$.

Total thickness of the stringer-like TiCN layer 4, when the stringer-like TiCN layer is formed in a multi-layer structure, is preferably from 3 to 15 μm, especially 5 to 10 μm in order to improve breakage resistance while maintaining wear resistance and preventing peel-off of films.

Thickness of the $Al_2O_3$ layer 6 is preferably in a range from 1 to 10 μm, especially 3 to 8 μm and further 3.5 to 7 μm in order to improve breakage resistance while maintaining wear resistance and resistance against fusing with cast iron and preventing peel-off of films.

It is able to provide at least one intermediate layer 7 made of a material selected from among a group of TiN, TiCN, TiC, TiCNO, TiCO and TiNO, between the stringer-like TiCN layer 4*a* and the stringer-like TiCN layer 4*b* when the stringer-like TiCN layer 4 is formed in a multi-layer structure. Presence of the intermediate layer 7 makes it possible to prevent the components of the base body from diffusing, prevent wear resistance of the hard coating layer 3 from decreasing and mitigate the impact generated during cutting operation, so that breakage resistance can be improved for such cutting operations that generate particularly strong impact. Total thickness of the intermediate layer 7 is preferably from 0.1 to 1 μm in view of improving the breakage resistance.

It is desirable to form a TiN layer as a surface layer 9 of the hard coating layer 3. This layer renders the cutting tool 1 gold color so that putting the cutting tool 1 into use causes the color to change, thus making it easier to determine where the tool has been used or not, and check the progress of wear. Thickness of the TiN layer is preferably from 0.1 to 1 μm in view of improving the breakage resistance, and the color of a TiN layer appears clearly.

Furthermore, in order to prevent the breakage resistance fall by diffusion of the improvement in adhesion, and a substrate component between the stringer-like TiCN layer 4 and a body 2, it is desirable to cover a TiN layer (the lowest layer: not shown). Thickness of the TiN layer is preferably from 0.1 to 2 μm prevent from falling adhesion.

The $Al_2O_3$ layer 6 used in the present invention preferably has an α type crystal structure. $Al_2O_3$ layer of the α type crystal structure of the prior art has high wear resistance, but involves such problems as grain size is large when nucleation proceeds, resulting in smaller contact area with the stringer-like TiCN layer 4 which leads to weaker adhesion force and higher possibility of the films peeling off. According to the present invention, in contrast, since the contact area between the $Al_2O_3$ layer and the stringer-like TiCN layer 4 can be increased, sufficient adhesion force can be achieved even when the $Al_2O_3$ layer 6 is formed in an α type crystal structure. As a result, cutting tool 1 having longer service life can be obtained by making use of the high wear resistance of the $Al_2O_3$ layer of the α type crystal structure without decreasing the adhesion force of the $Al_2O_3$ layer.

When the $Al_2O_3$ layer 6 is to be formed in an α type crystal structure, it is preferable to interpose a TiCO layer, TiNO layer or TiCNO layer having thickness of 0.2 μm or less between the stringer-like TiCN layer 4 and the $Al_2O_3$ layer 6, since this enables stable growth of the α type crystal structure.

(Manufacturing Method)

The surface-coated cutting tool described above is manufactured by a process described below. An inorganic powder such as carbide, nitride, carbonitride, oxide or other compound of a metal that can be fired to make the hard alloy described above is mixed with such additives as metal powder and/or carbon powder, and is molded into the shape of the cutting tool by a known molding process such as press molding, casting, extrusion molding or cold hydrostatic press molding. The preform thus molded is fired in vacuum or non-oxidizing atmosphere thereby to make the base body 2 made of the hard alloy described above.

Then the base body 2 is coated with the hard coating layer 3 by, for example, chemical vapor deposition process. The stringer-like TiCN layer 4 is grown under such conditions as, for example, a reaction gas constituted from 0.1 to 10% by volume of $TiCl_4$ gas, 0 to 80% or preferably 0 to 60% by volume of $N_2$ gas, 0 to 0.1% by volume of $CH_4$ gas, 0.1 to 3% by volume of $CH_3CN$ gas and $H_2$ gas for the rest is introduced into a reaction chamber of which inner atmosphere is controlled at a temperature from 800 to 1100° C. and pressure from 5 to 85 kPa.

Mean crystal width $w_1$ of the stringer-like TiCN layer 4 on the $Al_2O_3$ layer 6 side can be made larger than the mean crystal width $w_2$ of the stringer-like TiCN layer 4 on the base body 2 side by making the proportion of $CH_3CN$ included in the reaction gas used for growth on the $Al_2O_3$ layer 6 side higher than the proportion of $CH_3CN$ included in the reaction gas used for growth on the base body 2 side. For example, when the proportion of $CH_3CN$ for the base body side is 1.1% by volume, proportion of $CH_3CN$ for the $Al_2O_3$ layer 6 side is set at 2.2% by volume. Alternatively, proportion of $CH_3CN$ in the reaction gas may also be increased stepwise as the growth of the film proceeds, it is good also form a TiCN layer as three or more-layers.

In the film forming conditions described above, when the proportion of $CH_3CN$ in the reaction gas is less than 0.1% by volume, the stringer-like TiCN layer 4 cannot be grown into stringer-like TiCN crystal. When the proportion of $CH_3CN$ in the reaction gas is more than 3% by volume, on the other hand, the mean crystal width w of the stringer-like TiCN crystal 8 of the stringer-like TiCN layer 4 cannot be controlled.

The mean crystal width of the stringer-like TiCN crystal of the stringer-like TiCN layer 4 can also be controlled by raising the deposition temperature when growing the stringer-like TiCN layer 4 on the $Al_2O_3$ layer 6 side, instead of controlling the proportion of $CH_3CN$ in the reaction gas.

After forming the stringer-like TiCN layer 4, the $Al_2O_3$ layer 6 is grown. To form the $Al_2O_3$ layer 6, it is preferable to use a gas mixture constituted from 3 to 20% by volume of $AlCl_3$ gas, 0.5 to 3.5% by volume of HCl gas, 0.01 to 5.0% by volume of $CO_2$ gas, 0 to 0.01% by volume of $H_2S$ gas and $H_2$ gas for the rest, with temperature set in a range from 900 to 1100° C. and pressure set in a range from 5 to 10 kPa.

In case the intermediate layer 7 is formed between the stringer-like TiCN layer 4*a* and the stringer-like TiCN layer 4*b* when forming the stringer-like TiCN layer 4 in a multilayer structure, if the intermediate layer 7 is made of TiN, for example, reaction gas constituted from 0.1 to 10% by volume of $TiCl_4$ gas, 20 to 60% by volume of $N_2$ gas and $H_2$ gas for the rest may be introduced into a reaction chamber of which inner atmosphere is controlled at a temperature in a range from 780 to 1100° C. and pressure in a range from 5 to 85 kPa.

To form the surface layer 9 from TiN, for example, on the cutting tool 1, reaction gas constituted from 0.1 to 10% by volume of $TiC_4$ gas, 0 to 60% by volume of $N_2$ gas and $H_2$ gas for the rest may be introduced into a reaction chamber of which inner atmosphere is controlled at a temperature in a range from 800 to 1100° C. and pressure in a range from 5 to 85 kPa.

To form the $Al_2O_3$ layer 6 in an α type crystal structure, the process is carried out after forming the stringer-like TiCN layer by introducing a gas mixture constituted from 0.1 to 3% by volume of $TiC_4$ gas, 0.1 to 10% by volume of $CH_4$ gas, 0.01 to 5.0% by volume of $CO_2$ gas, 0 to 60% by volume of $N_2$ gas and $H_2$ gas for the rest into a reaction chamber with temperature set in a range from 800 to 1100° C. and pressure set in a range from 5 to 85 kPa. By forming the multilayer film of any one layer or two layers or more of TiCO, TiNO, or a TiCNO film, and forming $Al_2O_3$ layer 6 by the above-mentioned method continuously, it is stabilized to form the $Al_2O_3$ layer 6 in an α type crystal structure.

Embodiment 2

This embodiment is to obtain the cutting tool 1 by coating the surface of the base body 2 with the hard coating layer 3 similarly to the above embodiment. The hard coating layer 3 consists of at least the titanium carbonitride (TiCN) layer and the alumina ($Al_2O_3$) layer formed successively on the surface of the base body 2, while the TiCN layer is formed from stringer-like TiCN crystal that is grown in a direction perpendicular to the interface with the base body and is constituted from at least two layers having different ratios C/N of proportions of carbon C and nitrogen N, namely a carbon-rich TiCN layer where C/N ratio is in a range of $1.5 \leqq C/N \leqq 4$ located at the top on the $Al_2O_3$ layer 3 side, and a nitrogen-rich TiCN layer located below the carbon-rich TiCN layer where the ratio C/N is in a range of $0.2 \leqq C/N \leqq 0.7$.

The ratio C/N of carbon C and nitrogen N in the TiCN layer is measured on a fracture surface of the coating film or a surface obtained by polishing the fracture surface to mirror finish, at a depth from a fracture side or a processing side of 1 μm by means of Auger electron spectroscopy or an X ray photo electro spectroscopy.

The above constitution makes it possible to improve the adhesion force between the base body, the TiCN layer (the carbon-rich TiCN layer and the nitrogen-rich TiCN layer) and the $Al_2O_3$ layer, and control the adhesion force of the $Al_2O_3$ layer in an appropriate range. Consequently, the hard coating film demonstrates high wear resistance without peeling off during continuous cutting operation, and the $Al_2O_3$ layer absorbs impact by means of microscopic peel-off and cracks even when the coating film experiences sporadic occurrence of strong impact during intermittent cutting operation. This enables it to prevent the $Al_2O_3$ layer from peeling off over a significant extent and prevent the hard coating film as a whole from chipping or peeling off. Moreover, even after the $Al_2O_3$ layer has peeled off, since the remaining carbon-rich TiCN layer that has been exposed has high wear resistance, wear does not progress quickly so that the cutting tool 1 maintains stable wear resistance and breakage resistance.

The TiCN layer (the carbon-rich TiCN layer and the nitrogen-rich TiCN layer) of the present invention is preferably made of stringer-like TiCN crystal that has aspect ratio (ratio of length to width of crystal in the direction of thickness (direction perpendicular to the interface with the base body) of the hard coating film) of 2 or higher. The TiCN layer may also be a mixed crystal that includes granular TiCN crystal in a proportion of 30% or less by area when observed on the longitudinal section.

It is also preferable that ratio $t_C/t_N$ of thickness $t_C$ of the carbon-rich TiCN layer to thickness $t_N$ of the nitrogen-rich TiCN layer is in a range from 0.4 to 1.2, especially from 0.5 to 1.0 in order to achieve optimum balance of wear resistance and breakage resistance.

The $Al_2O_3$ layer used in the present invention preferably has an α type crystal structure. However, while $Al_2O_3$ layer of the α type crystal structure has high wear resistance, adhesion force with the TiCN layer 4 may be extremely weak. For this reason, the mean crystal width of the carbon-rich TiCN layer located below the $Al_2O_3$ layer is preferably in a range from 0.5 to 1 μm.

In order to exhibit an excellent wear-resistance without film peeling during continuation cutting, and to exhibit an excellent breakage-resistance during intermittence cutting, it is desirable that the $Al_2O_3$ layer 6 formed as an upper layer of the TiCN layer 4 have an adhesion force of 10–50N, and particularly 10–30N in measurement of an adhesion force performed by a scratch examination, since only the $Al_2O_3$ layer 6 peels, and a tough TiCN layer 4 remains without peeling, thereby inhibiting rapid abrasion.

The scratch examination is the method for examining an adhesion force of each layer in the hard coating layer. That is, a blemish is given by rubbing a sample surface, at a certain velocity, with a stylus to which a certain load was applied, and a value of the load for which a hard coating layer of the sample peels is read as an adhesion force of the peeled-off layer.

As for $Al_2O_3$ layer 6 used for this invention, it is desirable for crystal structure to be alpha type. Hitherto, a contact-area of grains in an interface between $Al_2O_3$ layer 6 and a TiCN layer 4 becomes small, an adhesion force becomes weak, and the $Al_2O_3$ layer 6 tends to cause film peeling, since the aluminum oxide crystal with alpha type crystal structure has an excellent wear-resistance, while a grain size of the aluminum oxide crystal generated according to a nucleation is large.

However, according to the above-mentioned constitution, the tool having a longer tool life can be obtained, since the adhesion force of the $Al_2O_3$ layer 6 is easily controllable in the range of 10–50N, even if aluminum oxide crystal in the $Al_2O_3$ layer 6 is alpha type crystal structure.

States, such as thickness and a grain size of each layer of the TiCN layer 4, the $Al_2O_3$ layer 6, the interlayer, the surface layer, and the lowest layer are the same as those of the 1st embodiment.

(Manufacturing Method)

To manufacture the surface-coated cutting tool described above, first the base body is made from hard alloy similarly as previously described.

Then after polishing the surface of the base body 2 as required, a hard coating film is formed on the surface similarly as previously described. The stringer-like TiCN layer 4 is grown under such conditions as, for example, reaction gas constituted from 0.1 to 10% by volume of $TiCl_4$ gas, 0 to 80% by volume of $N_2$ gas, 0 to 0.1% by volume of $CH_4$ gas, 0.1 to 3% by volume of $CH_3CN$ gas and $H_2$ gas for the rest is introduced into a reaction chamber of which inner atmosphere is controlled at a temperature in a range from 800 to 1100° C. and pressure in a range from 5 to 85 kPa.

In order to change the C/N ratio of the TiCN layer, quantity of the reaction gas is changed. To form the carbon-rich TiCN layer having C/N ratio in a range of $1.5 \leqq C/N \leqq 4$ in the TiCN layer, content of $CH_3CN$ gas is set in a range from 0.9 to 3.0% by volume and content of $N_2$ gas is set in a range from 30 to 40% by volume. To form the nitrogen-rich TiCN layer having C/N ratio in a range of $0.2 \leqq CiN \leqq 0.7$, content of $CH_3CN$ gas may be set in a range from 0.1 to 0.7% by volume and content of $N_2$ gas may be set in a range from 35 to 45% by volume.

In the film forming conditions described above, when the proportion of $CH_3CN$ gas in the reaction gas is less than 0.1% by volume, the stringer-like TiCN crystal cannot be grown and granular crystal is obtained instead. When flow rate of the reaction gas deviates out of the range described above, C/N ratio in the TiCN layer tends to deviate out of the range of the present invention. Crystal width of the stringer-like TiCN grains in the TiCN layer can be varied by adjusting the TiCN layer forming temperature in a range from 850 to 1050° C.

Then the $Al_2O_3$ layer is formed similarly as described previously. The TiN, TiC, TiCNO, TiCO, TiNO layer which makes the lowest layer, the middle layer, and the surface layer can also be formed similarly as described previously.

The rest of the process is similar to that described previously.

Embodiment 3

Figure 3:
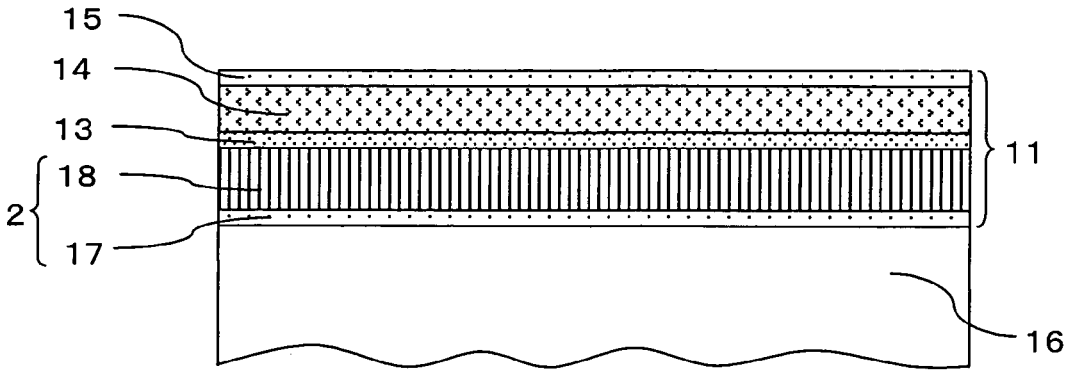
FIG. 3 is a schematic diagram showing an example of the constitution of hard coating film of the surface-coated cutting tool according to the present invention.

The cutting tool of this embodiment will be described below with reference to FIG. 3 through FIG. 6. In FIG. 3, the cutting tool of the present invention comprises a base body 16 made of tungsten carbide-based cemented carbide and a hard coating film 11 formed so as to coat the surface of the base body by successively forming a Ti-based layer (first layer) containing the TiCN layer 12 mentioned above and an $Al_2O_3$ layer 14 (third layer).

A binding layer 13 (second layer) that includes at least titanium (Ti), aluminum (Al), tungsten (W) and cobalt (Co) is interposed between the Ti-based layer containing the TiCN layer 12 and the $Al_2O_3$ layer 14. The binding layer 13 serves the role of the intermediate layer to increase the adhesion force between the TiCN layer 12 and the $Al_2O_3$ layer 14, increase the adhesion force of the hard coating layer 1 and suppress the cutting performance such as chipping resistance, film peel-off resistance and wear resistance from decreasing during cutting operation.

The binding layer 13 is preferably formed through diffusion of elements included in the base body 16, the Ti-based layer or the $Al_2O_3$ layer 14. Since elements included in the Ti-based layer and the $Al_2O_3$ layer 14 are taken into the binding layer 13, adhesion force is increased between the binding layer 13 and the Ti-based layer and between the binding layer 13 and the $Al_2O_3$ layer 14, thus increasing the resistance against peel-off of these layers. Moreover, since adhesion force and toughness of the binding layer 13 are improved by the inclusion of W and Co that are elements included in the base body 16, breakage resistance and chipping resistance are also improved.

Figure 4:
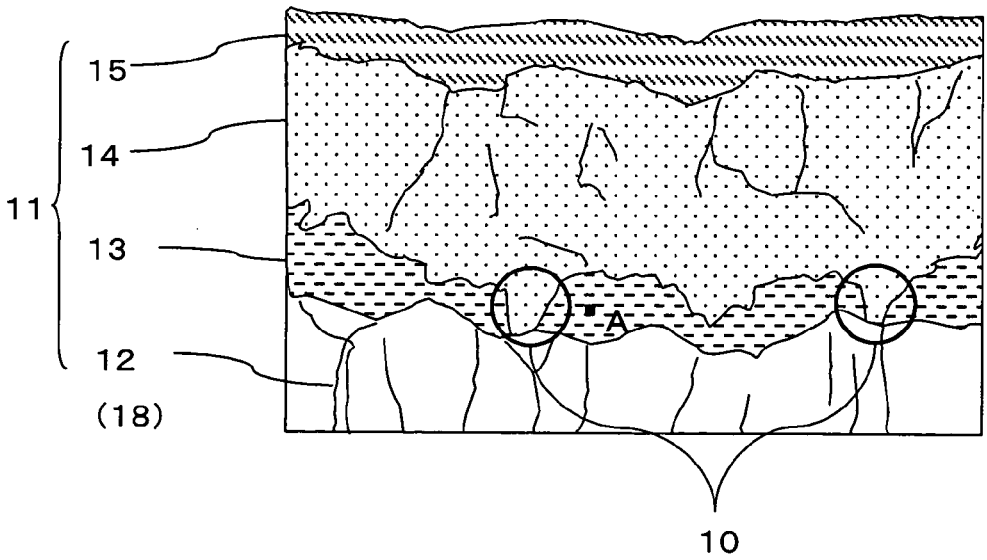
FIG. 4 is a schematic diagram showing a portion near the binding layer of the surface-coated cutting tool according to the present invention.

Furthermore, intermittent presence of the binding layer 13 enables it to optimize the residual stress acting on the hard coating layer 11, peel-off and chipping due to residual stress can be prevented. Intermittent presence means that the binding layer 13 has interrupts 10 as shown in FIG. 4. When it is assumed that the binding layer 13 had continuous and uniform structure (there were no interrupts), the mean thickness of the binding layer 13 is preferably in a range from 0.05 to 4 μm as this enables it to improve the adhesion force between the TiCN layer 12 and the $Al_2O_3$ layer 14, and prevent the adhesion force from decreasing due to the increase in the film thickness.

Figure 6:
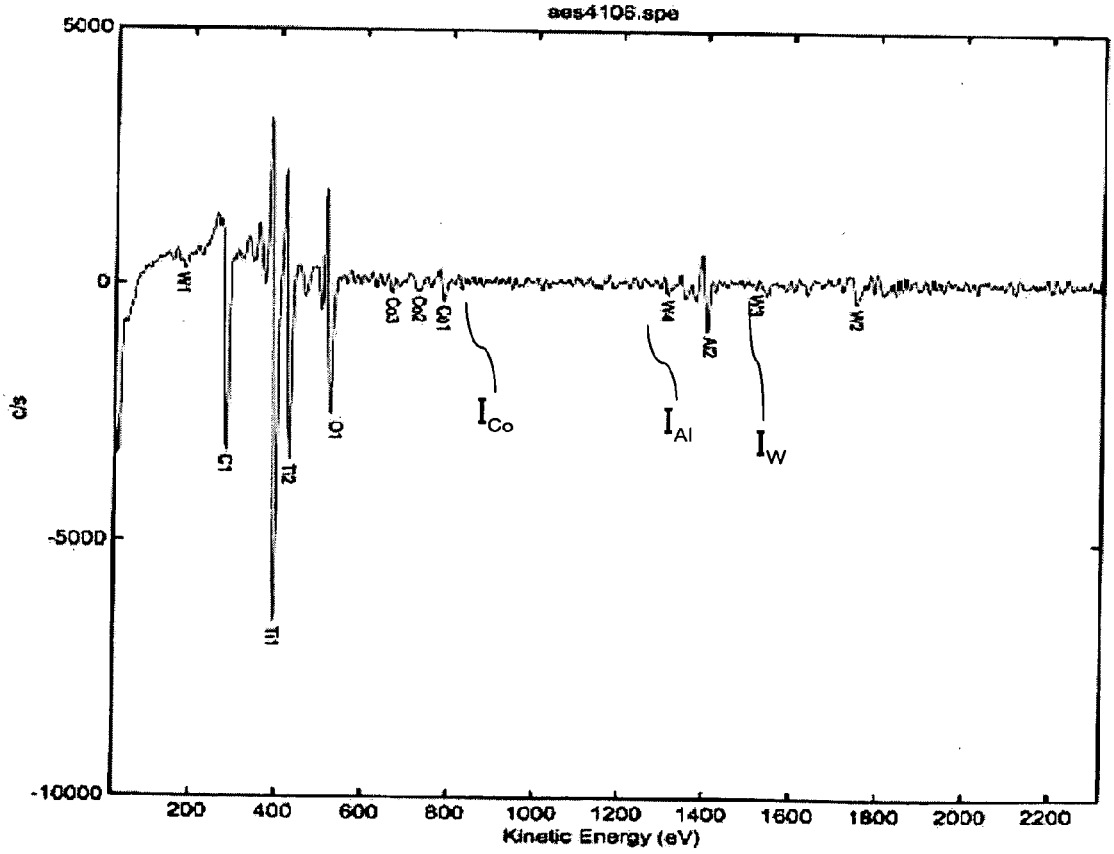
FIG. 6 shows the result of Auger electron spectroscopy analysis of the binding layer (point A) of the surface-coated cutting tool (FIG. 2) according to the present invention.

As shown in FIG. 6, the peak intensity of Al near 1400 eV, peak intensity of W near 1750 eV and peak intensity of Co near 800 eV in the observation of the binding layer 13 by Auger electron spectroscopy are denoted as $I_{Al}$, $I_W$ and $I_{Co}$, respectively. Then setting the ratio $I_W/I_{Al}$ in a range from 0.1 to 0.5 and ratio $I_{Co}/I_{Al}$ in the range from 0.1 to 0.5 prevents W and Co from diffusing excessively and becoming a source of destruction and improves the chipping resistance.

The $Al_2O_3$ layer 14 may include compounds such as carbide, nitride, carbonitride, carbooxide or carbonitride oxide of Ti generated due to diffusion during heat treatment which will be described later.

When the top surface 18 of the TiCN layer 12 is constituted from TiCN in the form of stringer-like grains of which mean grain width is larger than a lower layer of the TiCN layer 12, the breakage resistance can be improved without compromising the wear resistance. It is preferable to set the mean thickness of the TiCN layer in a range from 1 to 10 μm, more preferably in a range from 3 to 8 μm, for improving toughness of the $Al_2O_3$ layer 14 and prevent adhesion force from decreasing due to increasing thickness.

Figure 5:
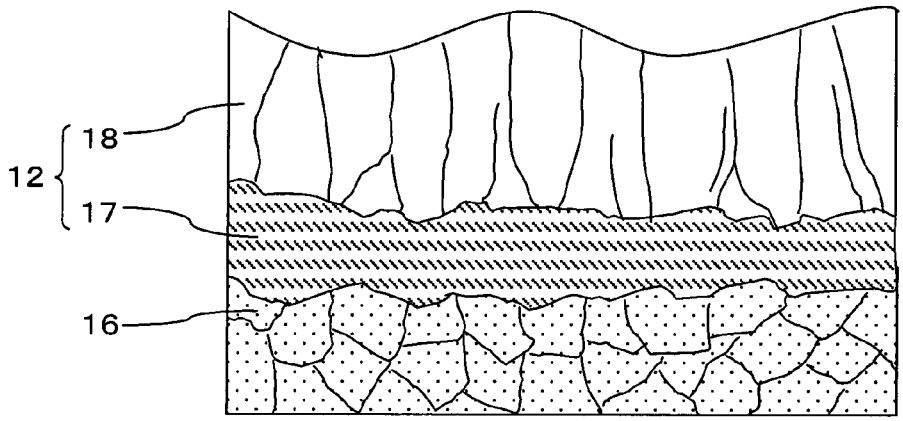
FIG. 5 is a schematic diagram showing a portion near the interface of base body (base layer) of the surface-coated cutting tool according to the present invention.

It is also desirable that a base layer 17 comprising TiN (titanium nitride) of granular crystal is included as the Ti-based layer as shown in FIG. 5, in order to improve resistance against peel-off and chipping resistance in heavy load cutting operations such as machining of casting surface of cast iron through synergy effect of improving the adhesion force between the base body 16 and the TiCN layer 12 and improving the adhesion force between the TiCN layer 12 and the $Al_2O_3$ layer 14. Since the amounts of W and Co diffusing from the base body can be controlled by means of TiN, thickness of the binding layer 13 can be controlled and the chipping resistance of the hard coating layer 11 due to excessive diffusion of W and Co can be prevented from decreasing.

Mean thickness of the base layer 17 is preferably in a range from 0.5 to 2.0 μm in order to improve the adhesion force of the $Al_2O_3$ layer 14, improve the resistance of the film against peel-off and chipping resistance and prevent the adhesion force from decreasing due to increasing thickness.

It is desirable that concentrations of W and Co in the region of the base body 16 made of tungsten carbide-based cemented carbide at a depth of 0.05 to 3 μm from the surface are higher than those of deeper portions, in order to absorb impact caused by cutting operation and improve breakage resistance of the hard coating layer 1.

It is also desirable that the concentrations of W and Co in the binding layer 13 are twice or more higher the concentrations of W and Co in the Ti-based layer and the $Al_2O_3$ layer 14, and preferably W and Co in the TiCN layer 12 and the $Al_2O_3$ layer 14 (third layer) are 1% by weight or less, particularly 0.5% by weight or less and are not detected, while being detected only in the binding layer 13, as it strengthens the adhesion force of between the TiCN layer and the $Al_2O_3$ layer and prevent wear resistance of the hard coating layer 1 from decreasing.

It is desirable to provide a TiN layer similar to the surface layer 9 shown in FIG. 1, as a surface layer 15 of the hard coating layer 11.

Others are the same as that of the above-mentioned embodiments.

(Manufacturing Method)

The cutting tool described above is manufactured by a process described below. An inorganic powder of WC and carbide, nitride, carbonitride or other compound of metal of 4*a*, 5*a* or 6*a* group is mixed with such additives as metal powder or carbon powder, and is molded into the shape of the cutting tool by a known molding process such as press molding, casting, extrusion molding, cold hydrostatic press molding. The preform thus molded is fired in vacuum or non-oxidizing atmosphere thereby to make the base body made of tungsten carbide-based cemented carbide.

Then the base body is polished and is coated with a hard coating layer by chemical vapor deposition process. Conditions of forming the layers are as follows.

The stringer-like TiCN layer and the $Al_2O_3$ layer 4 are grown under conditions similar to those described above. After successively forming the TiCN layer 12 and the $Al_2O_3$ layer 14, heat treatment is carried out at a temperature from 850 to 1100° C. for a period of 1 to 10 hours in hydrogen or nitrogen atmosphere under a pressure of 1 to 40 kPa. This causes the binding layer 13 to be formed through diffusion of elements from the base body 16, the TiCN layer 12 and the $Al_2O_3$ layer 14.

A TiN film is formed as the surface layer 15 for the identification of used corner, as required. Thickness of the layers can also be controlled by means of the duration of film forming process, besides the conditions described above.

As the first layer formed on the base body, single or a plurality of layers such as TiC layer, TiN layer and granular TiCN layer may be formed, in addition to the stringer-like TiCN layer. The same conditions as the above-mentioned embodiments can be used for forming these layers.

The rest of the process is similar to the embodiments described previously.

Embodiment 4

Figure 8:
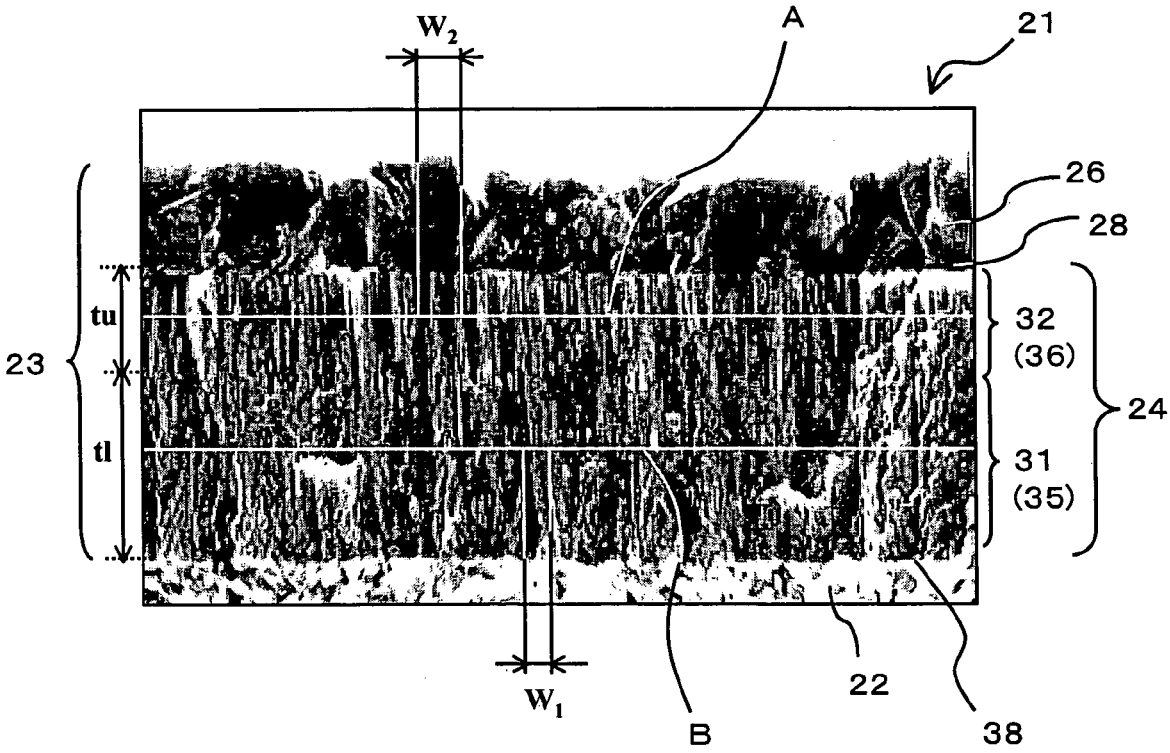
FIG. 8 is a scanning electron microscope image of a region of hard coating layer in a fracture surface of the surface-coated cutting tool according to the present invention.

A cutting tool 21 according to this embodiment comprises a base body 22 coated on the surface thereof with a hard coating layer 23 that is formed by chemical vapor deposition process (CVD) or the like as shown in FIG. 8. The base body 22 may be made of cemented carbide similar to that described previously, or ceramic such as Ti-based cermet, silicon nitride, aluminum nitride, diamond or cubic boron nitride.

Figure 7A:
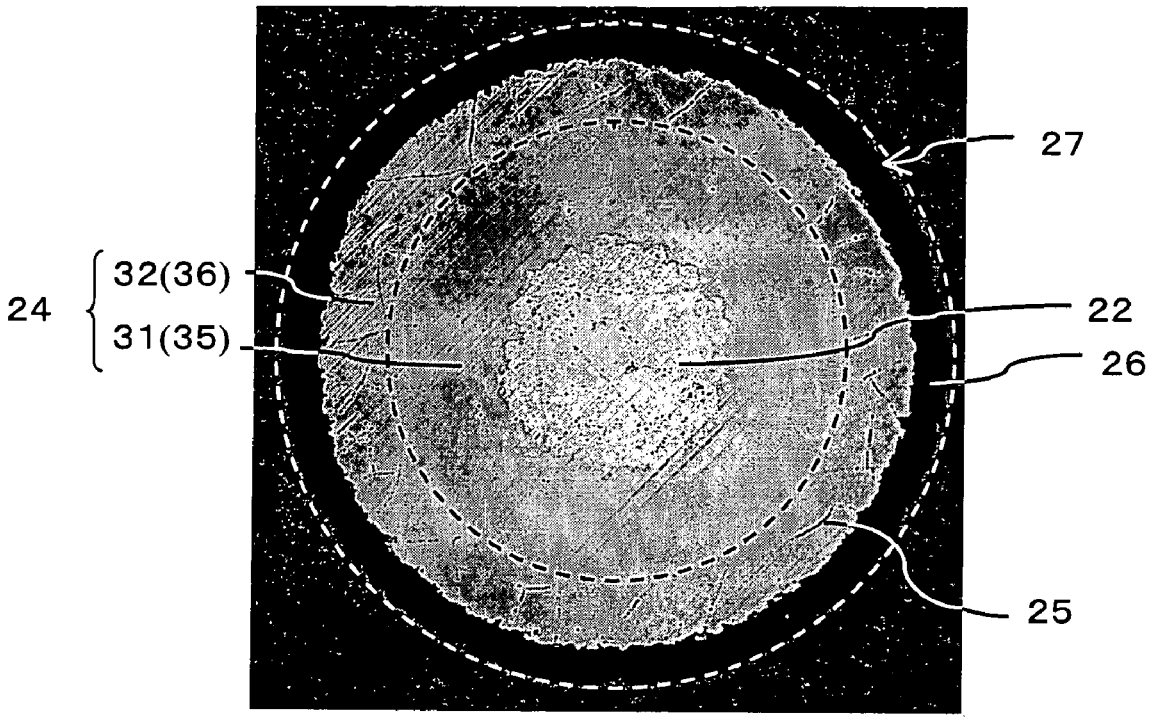
FIG. 7(*a*) and (*b*) show images of abrasion dent generated on surface-coated cutting tool in Calotest observed by a metallurgical microscope, (a) showing an example of the invention and (b) showing a comparative example.
Figure 7B:
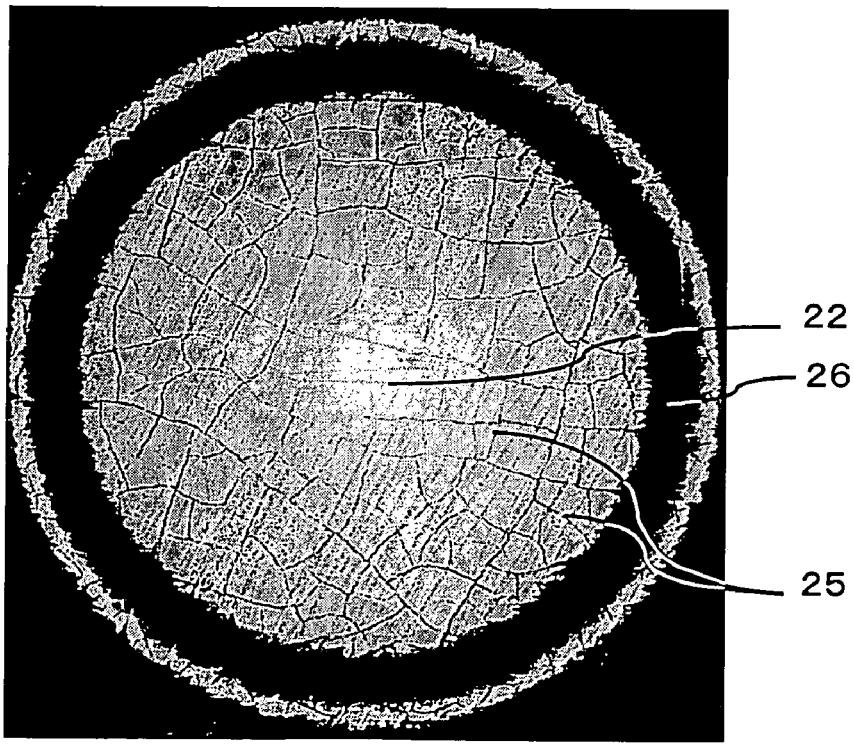

According to this embodiment, at least a titanium carbonitride (TiCN) layer 24 as a hard coating layer 23 and an aluminum oxide ($Al_2O_3$) layer 26 as an overlay thereof are provided as shown in FIG. 8. FIG. 7 shows an abrasion dent 27 generated in Calotest observed with a metallurgical microscope or a scanning electron microscope with magnifying power of 4 to 50 (5 in FIG. 7).

Figure 9:
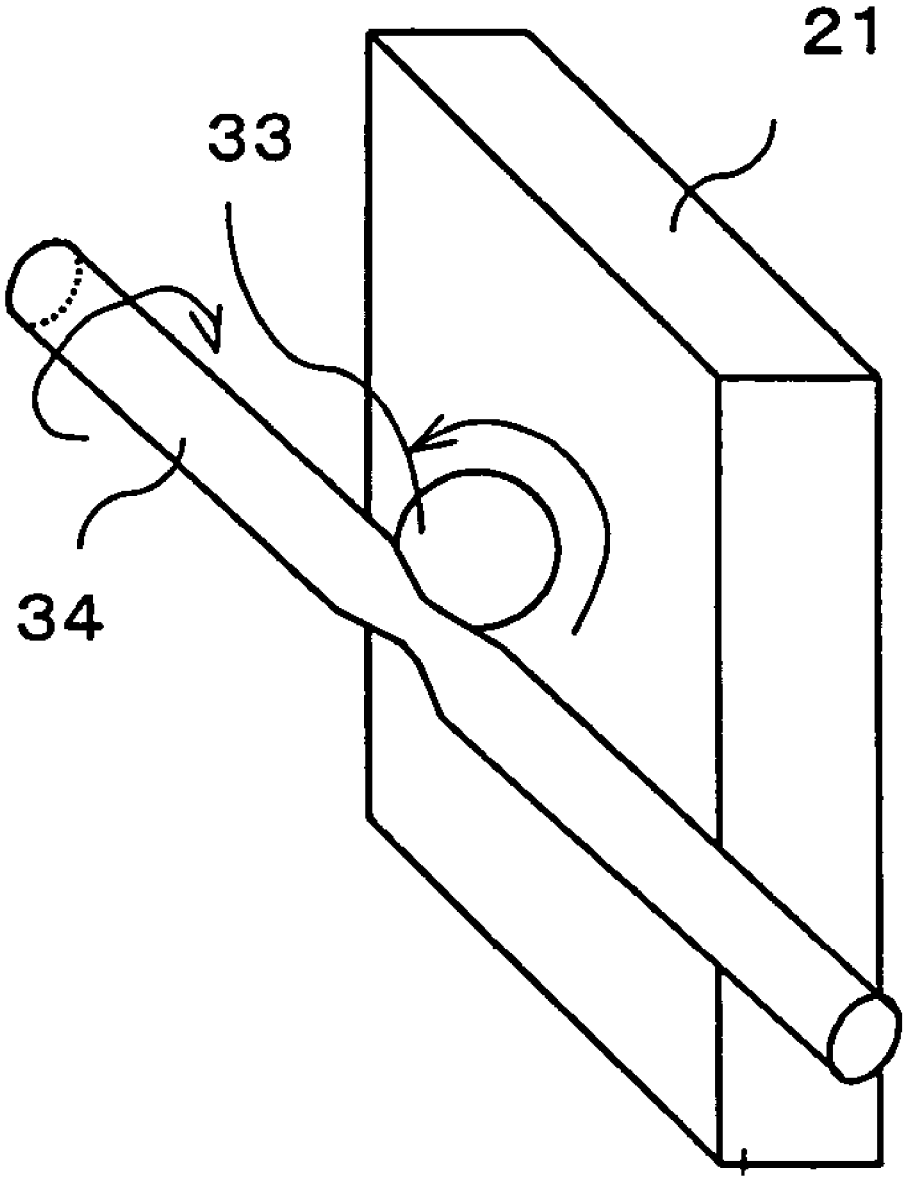
FIG. 9 is a schematic diagram explanatory of the method of Calotest.

Calotest is a method for estimating the thickness of each layer by observing the width of each layer of the hard coating layer 23 that can be observed in abrasion dent 27. The abrasion dent 27 is generated by placing a hard ball 33 made of a metal or cemented carbide on the surface of the cutting tool 21, namely the hard coating layer 23, rolling the hard ball 33 by rotating a support rod 34 that supports the hard ball 33, so as to cause local wear on the cutting tool 21, so that the hard coating layer 23 is worn in spherical shape with the base body 22 exposed at the center of the abrasion dent 27 as shown in FIG. 9.

According to the present invention, it is important that there are a lower structure 31 where crack width is zero or small and an upper structure 32 having larger crack width than that of the lower structure 31 located on the periphery of the lower structure 31, observed in the TiCN layer 24 on the circumference of the base body exposed at the center of the abrasion dent 27 generated in the Calotest as shown in FIG. 7(*a*).

In the constitution described above, residual stress generated due to the difference in thermal expansion coefficient between the $Al_2O_3$ layer 26 and the TiCN layer 24 when cooled after coating is relieved as cracks 25 occur in the upper structure 32 located on the outside of the TiCN 24. As a result, even when a significant impact is sporadically applied to the hard coating layer 23, the impact can be absorbed without causing new major cracks. Also because the lower structure 31 of the TiCN layer 24 where crack 25 is less likely to occur is provided, the crack 25 generated in the upper structure 32 is impeded from propagating, so that the TiCN layer 24 is prevented from being chipped or peeling off and wear resistance of the entire hard coating layer 23 is improved. As a result, such a cutting tool 21 is obtained that has excellent breakage resistance and chipping resistance even in heavy intermittent cutting of metals such as cast iron that contains high-hardness graphite grains scattered therein such as gray cast iron (FC) or ductile cast iron (FCD).

Unless there is the crack 25 in the upper structure 32 of the TiCN layer 24 as observed in the abrasion dent 27, residual stress between TiCN layer 24 and the $Al_2O_3$ layer 26 is not relieved. Failure to relieve the residual stress makes it likely that large cracks 25 develop in the TiCN layer 24 and/or the $Al_2O_3$ layer 26 when a large impact is applied to the hard coating layer 23, resulting in chipping or breakage of the hard coating layer. When cracks 25 are evenly distributed throughout the TiCN layer 24 as shown in FIG. 7(*b*), on the other hand, cracks 25 generated due to the residual stress in the $Al_2O_3$ layer 26 propagate throughout the TiCN layer 24, again resulting in higher possibility of chipping and/or breakage of the hard coating layer 23.

The abrasion dent 27 generated in the Calotest is a spherical wear of the hard coating layer 23 with the base body 22 exposed at the center thereof. Property and characteristic of the hard coating layer 23 can be evaluated by observing each layer in the hard coating layer 23 included in the abrasion dent 27 for wear, peeling, progress of cracks 25 and other conditions.

When the base body 22 is exposed excessively or insufficiently, cracks 25 in the TiCN layer 24 may not be accurately observed. For this reason, abrading conditions (duration, type of the hard ball, abrasion agent, etc.) of the Calotest are set preferably so that diameter of the base body 22 exposed in the abrasion dent 27 is 0.1 to 0.6 times the diameter of the abrasion dent 27.

Also as shown in the photograph taken by scanning electron microscope (FIG. 8) that shows the structure of the hard coating layer 23, it is preferable that ratio $b_1/b_2$ of the crack width b, observed in the lower structure 31 of the TiCN layer 24 to the crack width $b_2$ observed in the upper structure 12 is ½ or less, more particularly ⅓ or less, in order to obtain high adhesion force between the TiCN layer 24 and the $Al_2O_3$ layer 26, suppress the progress of the crack 25 in the TiCN layer 24, improve the chipping resistance and breakage resistance of the hard coating layer 23 as a whole and maintain wear resistance.

Figure 10:
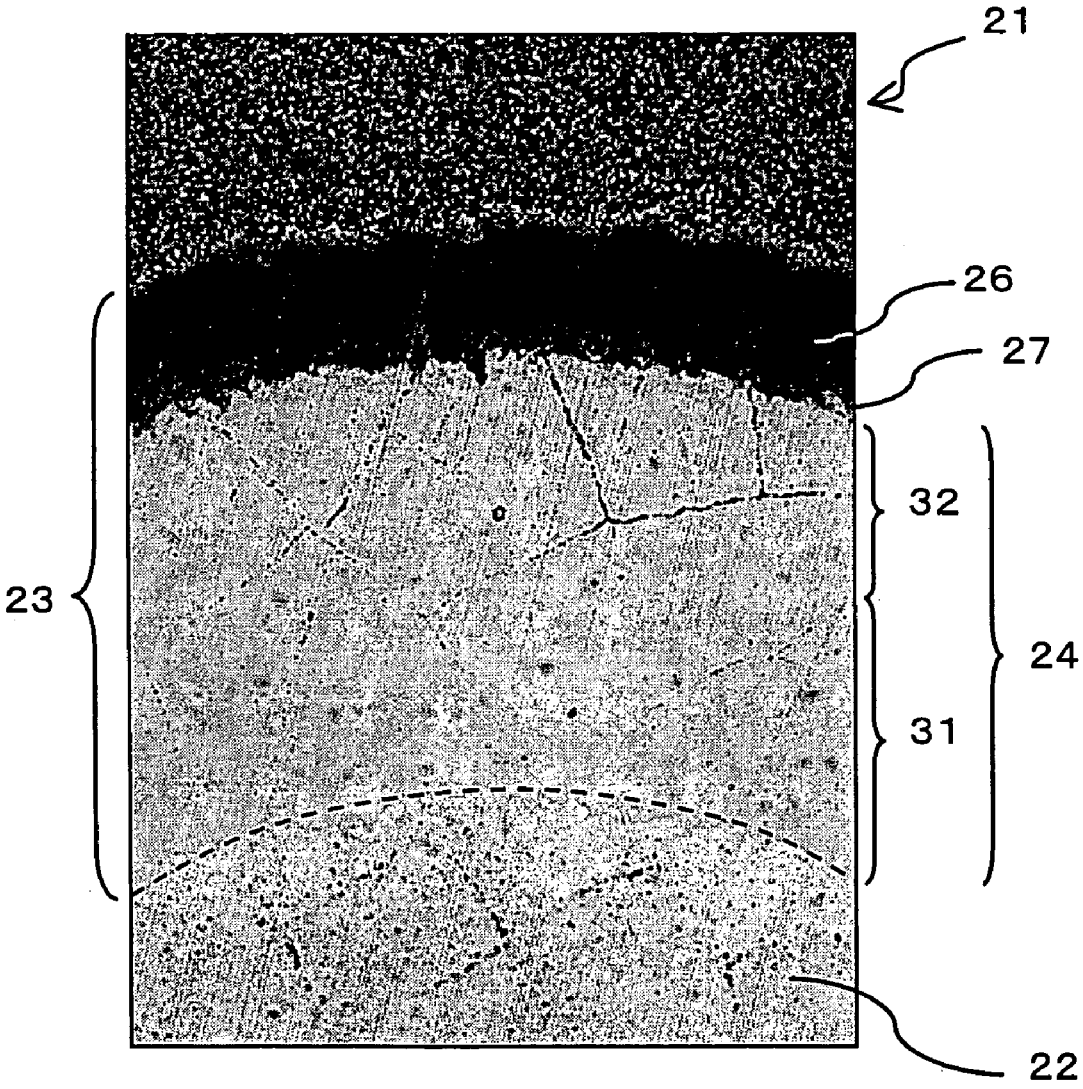
FIG. 10 is an enlarged photograph of a portion of interest of metallurgical microscope image of the abrasion dent shown in FIG. 7(*a*).
Figure 11:
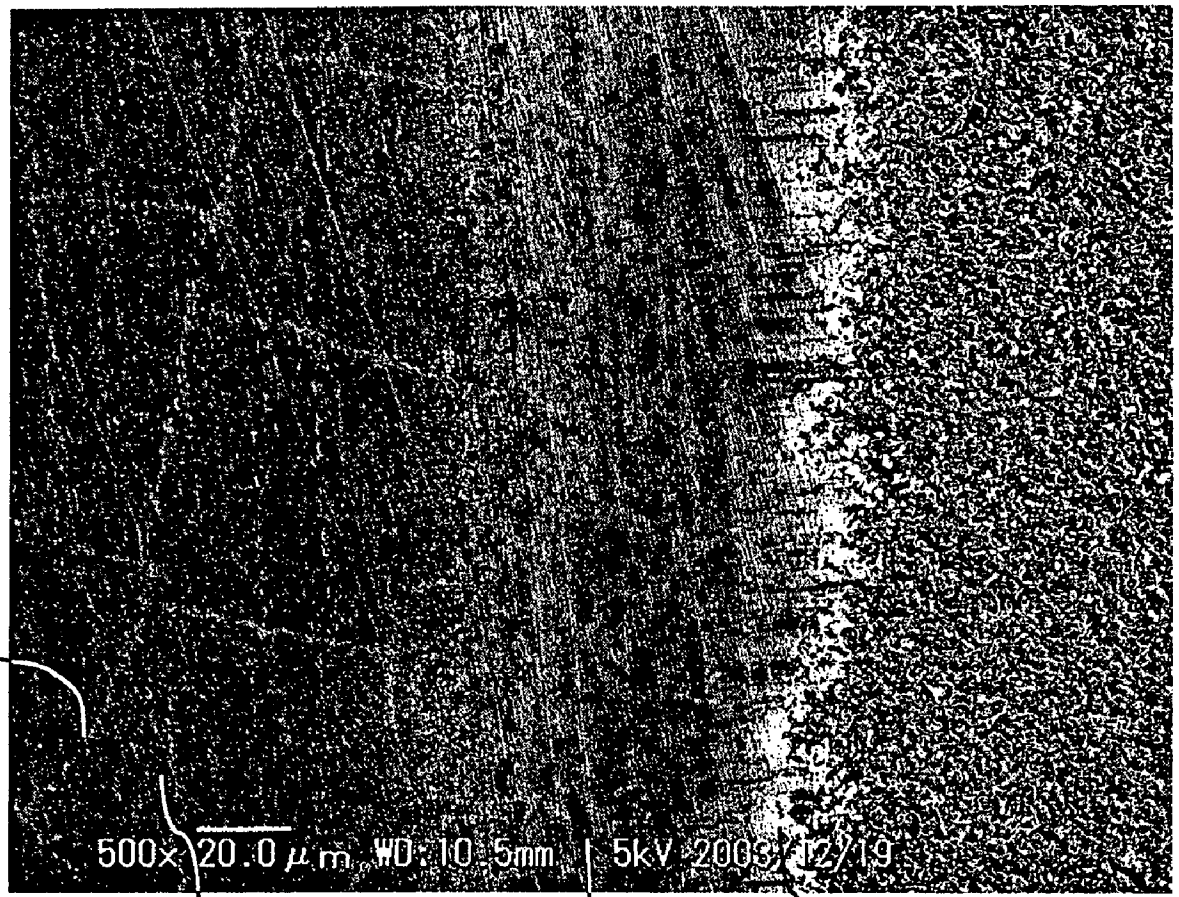
FIG. 11 is photograph taken with a scanning electron microscope (SEM) on the portion of FIG. 7(*a*).

Now making reference to FIG. 7, FIG. 8 or FIG. 10 which shows a key portion of FIG. 7, the TiCN layer 24 has such a constitution comprising a plurality of layers consisting of a lower TiCN layer (hereafter referred to simply as lower layer) 35 where crack width is zero or small observed on the periphery of the base body 22 exposed at the center of the abrasion dent 27, and an upper TiCN layer (hereafter referred to simply as upper layer) 36 having larger crack width than that of the lower layer 35 observed on the periphery of the lower layer 35. This constitution makes it possible to surely prevent chipping and breakage of the hard coating layer 23 as the cracks 25 generated in the upper portion of the TiCN layer do not propagate to the lower portion.

It is preferable that thickness $t_u$ of the upper layer 36 is in a range of $0.5\ \mu m \leqq t_u \leqq 5\ \mu m$ and thickness $t_1$ of the lower layer 35 is in a range of $1\ \mu m \leqq t_1 \leqq 10\ \mu m$ and two values of thickness satisfy an inequality $1 < t_1/t_u \leqq 5$, in order to obtain high adhesion force between the TiCN layer 24 and the $Al_2O_3$ layer 26, suppress the progress of the crack 25 in the TiCN layer 24, improve the impact resistance of the hard coating layer 23 as a whole, thereby to prevent chipping and breakage of the entire cutting tool 1 and maintain high wear resistance.

Also as shown in FIG. 8, the TiCN layer 24 is preferably constituted from titanium carbonitride grains having a stringer structure extending at right angles to the surface of the base body 2 while the upper layer 36 is formed in stringer structure of titanium carbonitride grains having a large mean crystal width $w_2$, and the lower layer 35 is formed in stringer structure of titanium carbonitride grains having a small mean crystal width $w_1$, in order to suppress the progress of the crack 25 generated in the upper layer 36 from propagating into the lower layer 35 and reduce the residual stress between the $Al_2O_3$ layer 26 and the TiCN layer 24, thereby minimizing occurrence of cracks and controlling the adhesion force between both layers. This makes it possible to improve the wear resistance and peel-off resistance of the hard coating layer 23, thereby to optimize the wear resistance and breakage resistance of the cutting tool 21 as a whole.

The titanium carbonitride grains having a stringer structure extending at right angles to the surface of the base body 22 described above means a crystal structure having aspect ratio (ratio of length to width of crystal in the direction perpendicular to the interface with the base body 22) of 2 or higher. The crystal may also be a mixed crystal that includes granular tungsten carbide-based cemented carbide in a proportion of 30% by area or less when observed in the section of the hard coating layer 23 as shown in FIG. 8.

In this case, it is preferable that the mean crystal width $w_2$ in the upper layer 36 of the TiCN layer 24 is from 0.2 to 1.5 μm, particularly from 0.2 to 0.5 μm, and the mean crystal width $w_1$ in the lower layer 35 is 0.7 times the mean crystal width $w_2$ in the upper layer 36 or less, in order to improve the chipping resistance of the TiCN layer 24 and control the strength thereof to bond with the $Al_2O_3$ layer 26, thereby to improve the wear resistance and breakage resistance of the hard coating layer 23 as a whole.

Mean crystal width of titanium carbonitride grains having a stringer structure can be measured as follows. While observing a cross section that includes the hard coating layer 23 through photograph taken with scanning electron microscope, a straight line is drawn in parallel to the interface between the base body 22 and the hard coating layer 23 in each region in height of the TiCN layer 24 (line segments A, B in FIG. 10), and the mean width of grains lying on the line segment, namely length of the line segment divided by the number of grains that cross the line segment, is taken as the mean crystal width w.

Similarly to the above embodiment, when at least one layer selected from among a group consisting of TiN layer, TiC layer, TiCO layer, TiCNO layer and TiNO layer is interposed between the base body 22 and the TiCN layer 24, between the TiCN layer 24 and the $Al_2O_3$ layer 26, between the multiple TiCN layers or on the $Al_2O_3$ layer, it is possible to achieve prevention of components of the base body 22 from diffusing, improvement of adhesion force between component layers of the hard coating layer 23, control of the structures, crystal structures, adhesion force and occurrence of cracks of the TiCN layer 24 and the $Al_2O_3$ layer 26. It is particularly preferable to interpose a titanium nitride layer on the bottom layer 38 and the surface layer 39. Thickness of the bottom layer 38 is preferably in a range from 0.1 to 2 μm, and thickness of the surface layer 39 is preferably in a range from 0.1 to 1 μm, in order to prevent adhesion force from decreasing.

When composition of the TiCN layer 24 is expressed as $Ti(C_{1-x}N_x)$, it is preferable that value of x is in a range from 0.55 to 0.80 in the lower layer 35 and in a range from 0.40 to 0.55 in the lower layer 16, namely, composition of the TiCN layer 24 consists of a carbon-rich TiCN layer located on top of said $Al_2O_3$ layer where the ratio C/N of proportions of carbon C and nitrogen N is in a range of $1.5 \leqq C/N \leqq 4$, and a nitrogen-rich TiCN layer located below the carbon-rich TiCN layer where the ratio C/N is in a range of $0.2 \leqq C/N \leqq 0.7$, in order to suppress the progress of the crack 25 generated in the upper layer 36 from propagating into the lower layer 35 and improve the breakage resistance and chipping resistance of the hard coating layer 23.

When the adhesion force of the $Al_2O_3$ layer 26 is from 10 to 50 N as measured by scratch test, peel-off of the hard coating film 23 can be suppressed and wear resistance can be improved during continuous cutting operation, and the $Al_2O_3$ layer absorbs impact by means of microscopic peel-off so as to suppress peel-off of the hard layer 23 extending to the base body 22 thereby improving the breakage resistance and chipping resistance during intermittent cutting operation.

It is desired that cracks are observed to extend from the interface between the $Al_2O_3$ layer 26 and the TiCN 24 to the inside of the $Al_2O_3$ layer 26 in the observation of abrasion dent in Calotest, for effectively relieving the residual stress generated in the interface between the $Al_2O_3$ layer 26 and the TiCN 24, preventing excessive cracks from occurring in the TiCN layer 24 and preventing chipping and peeling of the TiCN layer 24.

The $Al_2O_3$ layer 26 formed as the top layer of the TiCN layer 24 preferably has adhesion force from 10 to 50 N, more preferably from 10 to 30 N as measured by scratch test, in order to suppress peel-off of the film and achieve excellent wear resistance during continuous cutting operation, and keep the tough TiCN layer 24 to remain without peeling by allowing only the $Al_2O_3$ layer 26 to peel off thereby suppressing rapid progress of wear and demonstrate excellent chipping resistance during intermittent cutting operation.

The rest of the embodiment is similar to that described previously.

(Manufacturing Method)

To manufacture the surface-coated cutting tool described above, first the base body 22 is made from hard alloy similarly to that described previously.

Then after polishing the surface of the base body 22 as required, the hard coating layer 23 is formed on the surface by, for example, chemical vapor deposition (CVD) process. Conditions for forming the stringer-like TiCN layer 24 are similar to those described previously.

In this embodiment, grain size of the titanium carbonitride grains is made larger in the upper layer 32 than in the lower layer 31, by mixing higher proportion of acetonitrile ($CH_3CN$) gas in the reaction gas supplied in the latter stage of TiCN layer forming process (formation of the upper layer 32) than in the early stage of TiCN layer forming process (formation of the lower layer 31).

Specifically, the grain size can be controlled by setting the proportion of acetonitrile gas introduced in the latter stage of TiCN layer forming process at 1.5 times the proportion of acetonitrile gas introduced in the early stage of TiCN layer forming process.

In the film forming conditions described above, when the proportion of acetonitrile gas in the reaction gas is less than 0.1% by volume, stringer-like titanium carbonitride crystal cannot be grown and granular crystal is formed instead. When the proportion of acetonitrile gas in the reaction gas is more than 3% by volume, on the other hand, the mean crystal width of titanium carbonitride crystal becomes larger and the ratio cannot be controlled.

Mean crystal width of titanium carbonitride crystal can be controlled to the predetermined constitution by setting the film forming temperature higher in the latter stage of film formation than in the early stage of film formation, instead of changing the quantity of acetonitrile gas introduced into the reaction gas.

Then the $Al_2O_3$ layer 26 is formed similarly as described previously. The intermediate layer 28 may be formed similarly as described previously, as required.

Structure of the TiCN layer can be controlled so that predetermined cracks are observed in Calotest by controlling the rate of cooling the reaction chamber, after forming the hard coating layer by the chemical vapor deposition process, down to 700° C. in a range from 12 to 30° C./min. in addition to the method described above.

The rest of the process is similar to the embodiments described previously.

Embodiment 5

The cutting tool of this embodiment comprises the base body 22 and the hard coating layer 23 formed on the surface of the former similarly to the fourth embodiment. Therefore, components identical with those of the fourth embodiment will be identified with the same reference numerals as those used in FIG. 7 through FIG. 12 and detailed description will be omitted.

Figure 13A:
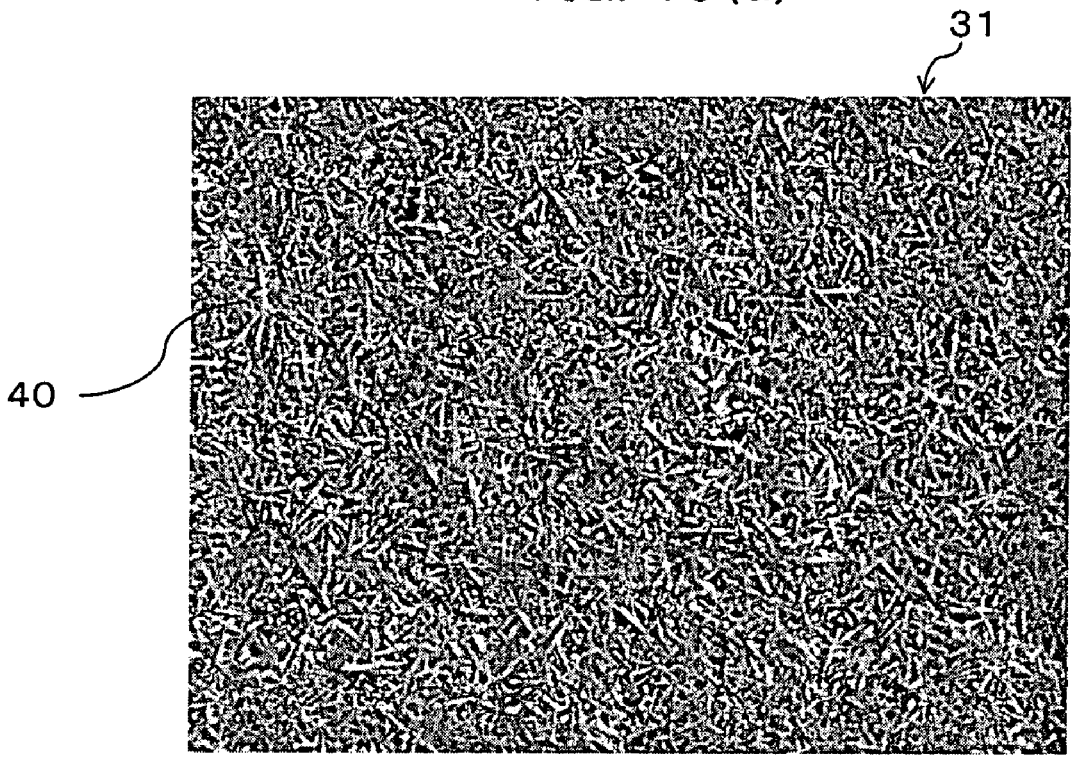
FIG. 13(*a*) is a is photograph taken with a scanning electron microscope on the surface of a structure appropriate for fine grain titanium carbonitride layer, and FIG. 13(*b*) is a photograph taken with scanning electron microscope on the surface of titanium carbonitride layer (the structure appropriate for the titanium carbonitride layer).
Figure 13B:
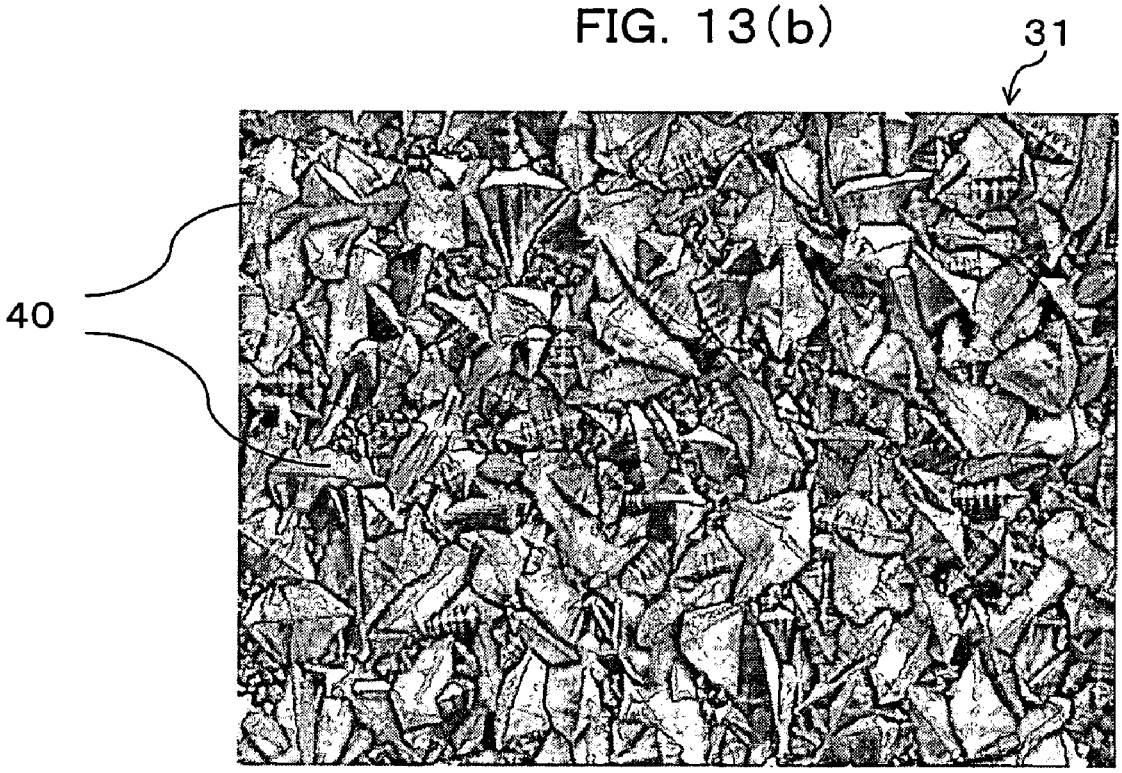

According to this embodiment, the hard coating layer 23 has such a constitution as at least one layer of titanium carbonitride layer 24 formed on the surface of the base body 22, and such a lower structure 31 that is formed on at least a part of the titanium carbonitride layer 24 which shows stringer structure extending at right angles to the surface of the base body 22 and shows needle-like structure extending in random directions when the titanium carbonitride layer 24 is observed from the surface of as shown in FIG. 13(*a*), (*b*).

This constitution enables it to prevent strong impact from being applied to the titanium carbonitride layer 24 in the direction of thickness, and suppress the propagation of cracks within the plane of the titanium carbonitride layer 24. As a result, the cutting tool 21 that has excellent wear resistance and breakage resistance and is free from chipping and peel-off of the titanium carbonitride layer 24 can be obtained.

When a strong impact is applied in the titanium carbonitride layer 24 having such a structure as the titanium carbonitride grains 40 show stringer structure when observed in the vertical cross section of the lower structure 31 (fine grain titanium carbonitride layer) and the titanium carbonitride grains 40 do not show needle-like structure when the lower structure 31 is observed from the surface thereof, the effect of the lower structure 31 to absorb impact and the effect of sufficiently deflecting and suppressing the progress of fine cracks generated in the hard coating layer 23 are disabled and therefore the cutting edge becomes more liable to chipping, resulting in shorter service life of the cutting tool 21.

It is preferable that the titanium carbonitride grains 40 of the lower structure 31 grow vertically and are formed from stringer crystal having a mean aspect ratio of 3 or higher, preferably 5 or higher, as the vertical cross section of the titanium carbonitride grains 40 are observed, in order to increase the impact absorbing capability. It is more preferable that the aspect ratio is 8 or higher and particularly 10 or higher in order to increase hardness of the titanium carbonitride layer 3 and improve the wear resistance.

In order to improve the effect of deflecting the cracks and the effect of preventing the progress of cracks, the mean aspect ratio of the titanium carbonitride grains 8 when the lower structure 31 is observed from the surface is preferably 2 or higher, more preferably 3 or higher and most preferably 5 or higher.

When observations from the vertical cross section and from the surface are combined, it is presumed that the titanium carbonitride grains 40 in the lower structure (fine-grain titanium carbonitride layer) are composed of plate-like crystal. Aspect ratio of the grain (titanium carbonitride grains 40) can be estimated by determining the maximum value of the ratio of the length of short axis of grain that is perpendicular to the long axis to the length of the long axis of the grain for each grain, and averaging the values. The crystal may also be a mixed crystal that includes granular titanium carbonitride crystal in a proportion of 30% by area when observed on the cross section of the hard coating layer 3.

When observing the structure of the titanium carbonitride grains 40 in the direction of surface and measuring the mean aspect ratio, SEM can be used to observe the surface if the surface is the lower structure 31. When another layer exists on the lower structure 31, it is better to polish the surface so that the hard coating layer 23 remains only at a predetermined position and observe the polished surface with magnification factor of 5000 to 200000 with a transmission electron microscope (TEM). This method enables it to reliably study the structure of the titanium carbonitride grains of the lower structure 31 from the direction of surface, even when the hard coating layer 3 has a multi-layer structure having other hard layer on the lower structure 31.

When observing the structure in the direction of cross section and measuring the mean aspect ratio, it may be done by breaking or grinding the cutting tool 21 in a direction perpendicular to the surface of the base body 22 and observing the fractured or ground surface with magnification power of 3000 to 50000 with a scanning electron microscope (SEM).

FIG. 13 is an SEM photograph of the surface as the lower structure 31 is formed. It is preferable that the mean length of the titanium carbonitride grains 40 is 1 μm or less when the titanium carbonitride grains of the lower structure 31 are observed as shown in FIG. 13(*a*), in order to achieve high effect of deflecting cracks generated in the lower structure 31, improve the fracture toughness thereby to improve breakage resistance and chipping resistance of the hard coating layer 23 and improve the adhesion force between the base body 22 and the titanium carbonitride layer 24 thereby to prevent abnormal wear due to peel-off of film.

It is also preferable to form the upper structure 32 (upper titanium carbonitride layer), that has a mean crystal width of the titanium carbonitride grains larger than that of the lower structure 31, on the top surface of the lower structure 31 and form the aluminum oxide layer 26 on the surface of the upper structure 32, in order to increase the adhesion force between the aluminum oxide layer 26 and the titanium carbonitride layer 24, improve the adhesion force between the base body 22 and the titanium carbonitride layer 24 and prevent peel-off and chipping of the hard coating layer 23 of the aluminum oxide layer 26 and the titanium carbonitride layer 24.

Specifically, for example, the mean crystal width $w_1$ of the titanium carbonitride layer 24 (upper structure 32) at a position 0.5 μm ($h_1$ and line A in FIG. 1) from the interface with the aluminum oxide layer 26 toward the base body 22 at right angles is made larger than the mean crystal width $w_2$ of the titanium carbonitride layer 24 at a position 1 μm (at height $h_2$ and line B which is beyond a region of small crystal width w due to nucleation) from the interface with the base body 22 in the direction perpendicular to the interface. It is preferable that the mean crystal width $w_2$ of the titanium carbonitride grains of the lower structure 31 is in a range from 0.1 to 0.7 μm and the mean crystal width $w_1$ of the titanium carbonitride grains of the upper structure 32 is in a range from 0.5 to 1.0 μm, in order to increase the adhesion force between the base body 22 and the aluminum oxide layer 26 thereby to prevent the breakage resistance and wear resistance from decreasing due to film peel-off, and improve wear resistance of the hard coating layer 23.

It is preferable that thickness t, of the lower structure 31 is in a range of 1 μm$\leqq t_1 \leqq$10 μm and thickness $t_u$ of the upper structure 32 is in a range of 0.5 μm$\leqq t_u \leqq$5 μm while both values of thickness satisfy an inequality $1<t_1/t_u \leqq 5$, in order to obtain high adhesion force between base body 22, the titanium carbonitride layer 24 and the $Al_2O_3$ layer 26, and improve hardness and toughness of the cutting tool 21. Total thickness of the titanium carbonitride layer 24, when formed in a multi-layer structure, is preferably from 8 to 12 μm, in order to suppress peel-off of the films and maintain wear resistance.

In the upper structure 32, unlike the lower structure 31, it is desirable that the mean length of the titanium carbonitride grains is 1 μm or larger in order to improve the adhesion force with the $Al_2O_3$ layer 6, as shown in FIG. 13(*b*). In this case, aspect ratio of the titanium carbonitride grains may be 2 or less, but preferably in a range from 2 to 5.

The $Al_2O_3$ layer 26 preferably has adhesion force from 10 to 50 N, in order to improve both hardness and toughness, suppress peel-off of the hard coating layer 23 and achieve excellent wear resistance during continuous cutting operation, and suppress such a peel-off of the hard coating layer 3 that reaches the base body 2 by allowing only the $Al_2O_3$ layer 26 to experience minor peel-off thereby improving breakage resistance and chipping resistance during intermittent cutting operation.

It is preferable that there are a lower structure 31 where crack width is zero or small and an upper structure 32 having larger crack width than that of the lower structure 11 located on the periphery of the lower structure 11, in the titanium carbonitride layer 4 observed on the circumference of the base body 2 exposed at the center of the abrasion dent 14 generated in the Calotest conducted on the surface of the surface-coated cutting tool 1 as shown in FIG. 7, wherein the abrasion dent 14 having spherical surface is formed on the hard coating layer 23, as described previously.

Figure 12:
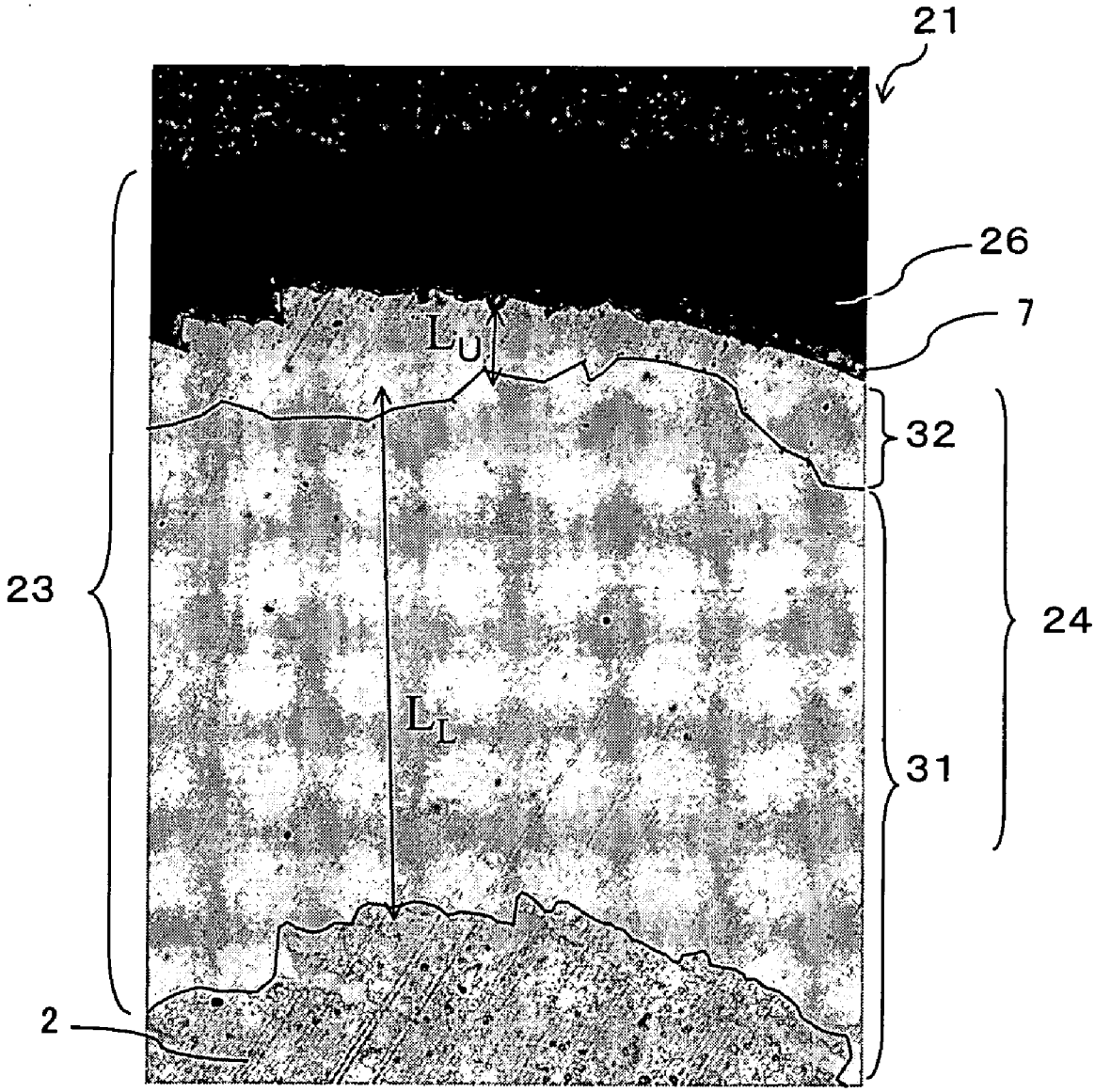
FIG. 12 is an enlarged photograph of another portion of interest of metallurgical microscope image of the abrasion dent shown in FIG. 7(*a*).

According to the above-mentioned constitution, as shown in FIG. 12, ratio $L_U/L$ of length $L_U$ in the radial direction of the upper structure to the length L in the radial direction of the entire titanium carbonitride layer ($L=L_U+L_L$, where $L_L$ is length in the radial direction of the lower structure) is preferably in a range from 0.05 to 0.15, which enables it to improve the breakage resistance of the titanium carbonitride layer.

(Manufacturing Method)

To manufacture the surface-coated cutting tool described above, first the base body 2 is made from hard alloy. Then after polishing the surface of the base body 2 as required, the hard coating layer 3 is formed on the surface by, for example, chemical vapor deposition (CVD). The titanium carbonitride layer 4 is grown under such conditions as, for example, reaction gas constituted from 0.1 to 10% by volume of titanium chloride ($TiCl_4$) gas, 0 to 60% by volume of nitrogen ($N_2$) gas, 0 to 0.1% by volume of methane ($CH_4$) gas, 0.1 to 0.4% by volume of $CH_3CN$ gas and hydrogen ($H_2$) gas for the rest is introduced into a reaction chamber of which inner atmosphere is controlled at a temperature from 780 to 840° C. and pressure from 5 to 85 kPa.

In the film forming conditions described above, when the proportion of $CH_3CN$ gas in the reaction gas is less than 0.1% by volume, structure of the titanium carbonitride grains in the lower structure 31 cannot be grown in the range described above. When the proportion of $CH_3CN$ gas in the reaction gas is more than 0.4% by volume, growth of the titanium carbonitride grains becomes too quick and structure of the titanium carbonitride grains cannot be controlled.

When the film forming temperature is below 780° C. or higher than 840° C., fine-grain titanium carbonitride layer constituted from titanium carbonitride grains that appear stringer like when observed in the cross section and needle-like when observed on the surface cannot be formed.

Grain size of the titanium carbonitride grains in the upper structure 32 can be made larger than in the lower structure 31, by mixing higher proportion of $CH_3CN$ gas in the reaction gas in the latter stage of forming the titanium carbonitride layer (formation of the upper layer 32) than in the early stage of forming the titanium carbonitride layer (formation of the lower layer 31).

Specifically, the grain size can be controlled by setting the proportion of $CH_3CN$ gas introduced in the latter stage of forming the titanium carbonitride layer at 1.5 times the proportion of acetonitrile gas introduced in the early stage of forming the titanium carbonitride layer.

The rest of the process is similar to that of the forgoing embodiments.

The present invention is not limited to the embodiments described above and various modifications and improvements can be made. For example, methods of forming the films by chemical vapor deposition (CVD) process have been described above, a part or the entire hard coating layer may also be formed by physical vapor deposition (PVD) process.

Although the surface-coated member is used for the surface coated cutting tool in the embodiments described above, the present invention is not limited to these embodiments, and can be applicable to, for example, machine parts including wear-resistance tools, such as an edged tool, a mold, and a digging tool; sliding members; and seal members.

The following examples further illustrate the manner in which the present invention can be practiced. It is understood, however, that the examples are for the purpose of illustration and the inventions are not to be regarded as limited to any of the specific materials or condition therein.

EXAMPLE I

Tungsten carbide (WC) powder having a mean particle size of 1.5 μm, metal cobalt (Co) powder having a mean particle size of 1.2 μm and a powder of inorganic compound of a metal of the group 4a, 5a or 6a of the Periodic Table having a mean particle size of 2.0 μm were mixed, and the mixture was formed in the shape of cutting tool (CNMA120412) by press molding and then a binder removing treatment was carried out, and temperature was raised at a rate of 3° C./min. above 1000° C., thereby to fire at 1500° C. in vacuum of 0.01 Pa for one hour so as to make cemented carbide.

The cemented carbide was coated with various hard coating layers under the conditions shown in Table 1 by CVD process so as to fabricate the sample cutting tools No. I-1 through 9 having film constitutions shown Table 2. The mean crystal width of the stringer-like TiCN layer was determined by counting the number of grains that crossed line A and line B at five points in an arbitrary fracture surface that included the hard coating layer of the cutting tool shown in FIG. 1, and averaging the values of the five points converted to crystal width of stringer-like TiCN crystal. When forming the $\alpha$-$Al_2O_3$ layer, TiCNO layer was formed to a thickness of 0.1 μm under the conditions shown in Table I before forming the $Al_2O_3$ layer.

While TiN layer having thickness of 1 μm was formed under the conditions shown in Table 1 as the surface layer on the $Al_2O_3$ layer for all samples, these are omitted from Table 2.

TABLE 1

| Coating Layer | Mixed Gas Composition (vol. %) | Rate of $CH_3CN$ Gas in Mixed Gas (vol. %) | Temperature (° C.) | Pressure (kPa) |
|---|---|---|---|---|
| TiCN1<c> | $TiCl_4$: 1.0, $N_2$: 43, $H_2$: rest | 1.1 | 865 | 9 |
| TiCN2<c> | $TiCl_4$: 1.0, $N_2$: 43, $H_2$: rest | 1.5 | 865 | 9 |
| TiCN3<c> | $TiCl_4$: 1.0, $N_2$: 43, $H_2$: rest | 1.8 | 865 | 9 |
| TiCN4<c> | $TiCl_4$: 0.8, $N_2$: 25, $H_2$: rest | 2.2 | 1015 | 50 |
| TiCN<p> | $TiCl_4$: 0.8, $N_2$: 25, $CH_4$: 7, $H_2$: rest | — | 1020 | 30 |
| TiCNO | $TiCl_4$: 0.7, $CH_4$: 4, $N_2$.: 5, $CO_2$: 0.01, $H_2$: rest | — | 1010 | 10 |
| Intermediate Layer TiN | $TiCl_4$: 0.5, $N_2$: 33, $H_2$: rest | — | 900 | 16 |
| $\kappa$ - $Al_2O_3$ | $AlCl_3$: 15, HCl: 2, $CO_2$: 4, $H_2S$: 0.01, $H_2$: rest | — | 1005 | 6 |
| $\alpha$ - $Al_2O_3$ | $AlCl_3$: 15, HCl: 2, $CO_2$: 4, $H_2S$: 0.01, $H_2$: rest | — | 1005 | 6 |
| Surface Layer TiN | $TiCl_4$: 0.5, $N_2$: 44, $H_2$: rest | — | 1010 | 80 |

TABLE 2

| Sample No. | Layers | | | | |
|---|---|---|---|---|---|
| | 1st Layer | 2nd Layer | 3rd Layer | 4th Layer | $Al_2O_3$ Layer |
| I-1 | TiCN1<c> (4.0)[0.3] | TiCN4<c> (3.0)[1.0] | — | — | α-$Al_2O_3$ (2.0) |
| I-2 | TiCN1<c> (3.0)[0.3] | TiN (0.5) | TiCN4<c> (3.0)[1.0] | — | α-$Al_2O_3$ (4.0) |
| I-3 | TiCN1<c> (1.0)[0.3] | TiCN2<c> (1.0)[0.5] | TiCN3<c> (1.0)[0.8] | TiCN4<c> (1.0)[1] | α-$Al_2O_3$ (3.0) |
| I-4 | TiCN1<c> (3.0)[0.3] | TICN0 (0.5) | TiCN3<c> (2.0)[0.8] | — | α-$Al_2O_3$ (2.0) |
| I-5 | TiCN1<c> (3.0)[0.3] | TiCN2<c> (3.0)[0.5] | TiCN3<c> (3.0)[0.8] | — | α-$Al_2O_3$ (3.0) |
| *I-6 | TiCN1<c> (3.0)[0.3] | TiCN1<c> (3.0)[0.3] | — | — | α-$Al_2O_3$ (4.0) |
| *I-7 | TiCN3<c> (3.0)[0.8] | TiN (0.5) | TiCN3<c> (3.0)[0.8] | — | κ-$Al_2O_3$ (4.0) |
| *I-8 | TiCN1<c> (7.0)[0.3] | — | — | — | α-$Al_2O_3$ (7.0) |
| *I-9 | TiCN<p> (5.0) | — | — | — | κ-$Al_2O_3$ (2.0) |

Sample numbers marked with * are not within the scope of the present invention.
( ) represents layer thickness, and
[ ] represents mean crystal width.
Unit is μm.
TiCN<c> and TiCN<p> represent columnar TiCN and particle TiCN, respectively.

The cutting tool was used to machine ductile cast iron for 25 minutes under the conditions shown below, then the cutting edge of the cutting tool was observed and the amounts of wear of the flank and the tip were measured. Intermittent cutting test and film peel-off test were conducted on grooved steels, and the number of impacts before chipping was counted in the intermittent cutting test. Cutting edge that had experienced 1000 impacts in the intermittent cutting test was observed under a microscope, to study the situation of peeling of the hard coating layer. Results of these tests are shown in Table 3.

(Wear Test)
Workpiece material: Ductile cast iron (FCD450)
Cutting tool shape: CNMA120412
Cutting speed: 350 m/min.
Feed rate: 0.4 mm/rev.
Cutting depth: 2 mm
Other condition: Aqueous coolant used.

(Intermittent Cutting Test)
Workpiece material: Carbon steel (S45C)
Cutting tool shape: CNMA120412
Cutting speed: 200 m/min.
Feed rate: 0.3 to 0.5 mm/rev.
Cutting depth: 2 mm
Other condition: Aqueous coolant used.

TABLE 3

| Sample No. | Flank Wear Amount or Top Wear AMOUNT(mm) | | Impact Number before Breakage | Peeling of Hard Layer |
|---|---|---|---|---|
| | Flank Wear Amount | Top Wear Amount | | |
| I-1 | 0.13 | 0.12 | 4000 | None |
| I-2 | 0.15 | 0.13 | 4500 | None |
| I-3 | 0.14 | 0.15 | 4200 | None |
| I-4 | 0.17 | 0.16 | 4800 | None |

TABLE 3-continued

| Sample No. | Flank Wear Amount or Top Wear AMOUNT(mm) | | Impact Number before Breakage | Peeling of Hard Layer |
|---|---|---|---|---|
| | Flank Wear Amount | Top Wear Amount | | |
| I-5 | 0.20 | 0.17 | 3600 | None |
| *I-6 | 0.32 | 0.34 | 1800 | $Al_2O_3$ Layer Peeling |
| *I-7 | 0.38 | 0.36 | 1600 | TiCN Layer Peeling |
| *I-8 | 0.38 | 0.37 | 1900 | TiCN Layer Peeling |
| *I-9 | 0.35 | 0.36 | 1500 | $Al_2O_3$ Layer Peeling |

Sample numbers marked with * are not within the scope of the present invention.

Tables 2 and 3 show that breakage resistance decreased significantly and breakage occurred early in the sample No. I-9 that had TiCN layer constituted from granular crystal. Wear due to the breakage proceeded rapidly.

In the sample No. I-8 comprising a single-layer TiCn layer, peel-off occurred in the cutting edge between the TiCN layer and the $Al_2O_3$ layer, resulting in decreased cutting performance.

In the samples Nos. I-6 and I-7 where two or more layers were formed under the same conditions and the stringer-like TiCN crystal of the TiCN layer has the same mean crystal width on the $Al_2O_3$ layer side and on the base body side thereof, peel-off of layers occurred in the interface between the stringer-like TiCN layer and the base body and in the interface between the stringer-like TiCN layer and the $Al_2O_3$ layer in the hard coating layer of the cutting edge resulting in a decrease in the breakage resistance, and abnormal wear proceeded from the site of peel-off accompanied by larger wear.

In any of the samples No. I-1 through I-5 where the mean crystal width of the stringer-like TiCN layer on the $Al_2O_3$ layer side was made larger than that of the stringer-like TiCN layer on the base body side, the hard coating layer did not peel off and excellent cutting performance was obtained in terms of both breakage resistance and wear resistance.

Comparative Example I

Cutting tools having the hard coating layer of the same constitution as that of the sample No. I-9 were fabricated under the same conditions as those of TiCN1 (c) shown in Table 1 of Example I, except for continuously increasing the proportion of $CH_3CN$ in the gas mixture from 1.1% by volume in the initial stage to 2.2% by volume at the end of film formation.

Mean crystal width of the stringer-like TiCN crystal in the stringer-like TiCN layer was 1.0 μm on the $Al_2O_3$ layer side, and was 0.3 μm on the base body side.

The cutting tools fabricated as described above were evaluated similarly as in Example I. Amount of wear observed in the wear resistance test was 0.22 mm on the flank and 0.21 mm on the tip. In chipping resistance test, chipping occurred after being subjected to 3200 impacts. Cutting edge did not show peel-off of the hard coating layer in the chipping resistance test.

EXAMPLE II

Tungsten carbide (WC) powder having a mean particle size of 1.5 μm was mixed with 6% by weight of metal cobalt (Co) powder having a mean particle size of 1.2 μm, 0.5% by weight of titanium carbide (TiC) powder having a mean particle size of 2.0 μm, and 5% by weight TaC powder, and the mixture was formed in the shape of the cutting tool (CNMA120412) by press molding. After the binder removing treatment was carried out, the preform was fired at 1500° C. in vacuum of 0.01 Pa for one hour so as to make cemented carbide.

The cemented carbide was coated with various hard coating layers under the conditions shown in Table 4 by CVD process to fabricate the cutting tools No. II-1 through II-8 having a multi-layer structure shown Table 5.

TABLE 4

| Coating Layer | Mixed Gas Composition (vol. %) | $CH_4$ Gas (vol. %) | $CH_3CN$ Gas (vol. %) | Temperature (° C.) | Pressure (kPa) |
|---|---|---|---|---|---|
| TiN1 | $TiCl_4$: 0.5, $N_2$: 33, $H_2$: rest | — | — | 900 | 16 |
| TiCN1 | $TiCl_4$: 1.0, $N_2$: 40, $H_2$: rest | — | 0.6 | 870 | 10 |
| TiCN2 | $TiCl_4$: 1.0, $N_2$: 40, $H_2$: rest | — | 0.6 | 1010 | 50 |
| TiCN3 | $TiCl_4$: 1.0, $N_2$: 30, $H_2$: rest | — | 1 | 870 | 10 |
| TiCN4 | $TiCl_4$: 1.0, $N_2$: 30, $H_2$: rest | — | 1 | 1010 | 50 |
| TiCN5 | $TiCl_4$: 2.0, $N_2$: 35, $H_2$: rest | — | 1.5 | 860 | 10 |
| TiCNO | $TiCl_4$: 0.7, $N_2$: 5, $CO_2$: 0.01, $H_2$: rest | 4 | — | 1010 | 10 |
| $Al_2O_3$ | $AlCl_3$: 15, HCl: 2, $CO_2$: 4, $H_2S$: 0.01, $H_2$: rest | — | — | 1005 | 6 |
| TiN2 | $TiCl_4$: 0.5, $N_2$: 44, $H_2$: rest | — | — | 1010 | 80 |

TABLE 5

| Sample No. | Lower Layer | TiCN film 1st Layer | TiCN film 2nd Layer | TiCN film 3rd Layer | Intermediate Layer | $Al_2O_3$ Layer | Surface Layer | Adhesion Force of $Al_2O_3$ Layer(N) | Peak number In X-ray Diffraction |
|---|---|---|---|---|---|---|---|---|---|
| II-1 | TiN1 (0.5) | TiCN1[0.3] <0.45>(4.0) | TiCN4[0.8] <3>(4.0) | — | TCN0 (0.2) | $Al_2O_3$ (3.5) | TiN2 (0.2) | 40 | 2 |
| II-2 | TiN1 (0.4) | TiCN4[0.3] <3>(2.0) | TiCN1[0.3] <0.45>(3.5) | TiCN4[0.8] <3>(3.5) | TiCN0 (0.5) | $Al_2O_3$ (3.0) | TiN2 (0.3) | 40 | 3 |
| II-3 | TiN1 (0.5) | TiCN1[0.3] <0.45>(4.0) | TiCN3[0.3] <3>(4.0) | — | TiC0 (0.3) | $Al_2O_3$ (2.5) | TiN2 (0.2) | 30 | 2 |
| II-4 | TiN1 (0.2) | TiCN2[0.8] <0.45>(4.0) | TiCN4[0.8] <3>(4.0) | — | — | $Al_2O_3$ (2.8) | TiN2 (0.2) | 40 | 2 |
| II-5 | — | TiCN1[0.3] <0.45>(2.0) | TiCN4[0.8] <3>(6.0) | — | TiN0 (0.5) | $Al_2O_3$ (2.5) | TiN2 (0.2) | 40 | 2 |
| II-6 | TiN1 (0.5) | TiCN1[0.3] <0.45>(6.0) | TiCN4[0.8] <3>(2.0) | — | TiCN0 (0.3) | $Al_2O_3$ (4.0) | — | 40 | 2 |
| *II-7 | TiN1 (0.5) | TiCN5[0.3] <0.5>(8.0) | — | — | TiCN0 (0.5) | $Al_2O_3$ (3.0) | TiN2 (0.2) | 60 | 1 |
| *II-8 | TiN1 (0.5) | TiCN3[0.3] <3>(4.0) | TiCN2[0.8] <0.45>(4.0) | — | TiCN0 (0.5) | $Al_2O_3$ (3.0) | TiN2 (0.1) | 50 | 2 |

Sample numbers marked with * are not within the scope of the present invention.
< > represents C/N ratio,
( ) represents layer thickness(μm), and
[ ] represents mean crystal width (μm).

The cutting tools were subjected to continuous cutting test and intermittent cutting test under the following conditions to evaluate the wear resistance and breakage resistance.

(Continuous Cutting Test)

Workpiece material: Ductile cast iron sleeve material (FCD700)

Cutting tool shape: CNMA120412

Cutting speed: 250 m/min.

Feed rate: 0.35 mm/rev.

Cutting depth: 2 mm

Cutting time: 25 minutes

Other condition: Aqueous coolant used.

Evaluation: Observation of cutting edge under microscope to measure the amounts of wear on flank and wear on tip.

(Intermittent Cutting Test)

Workpiece material: Ductile cast iron sleeve material with four grooves (FCD700)

Cutting tool shape: CNMA120412

Cutting speed: 200 m/min.

Feed rate: 0.35 mm/rev.

Cutting depth: 2 mm

Other condition: Aqueous coolant used.

Evaluation: Number of impacts before breaking (minimum value among ten samples)

TABLE 6

| Sample No. | Peak number in XRD | Flank Wear Amount or Top Wear Amount(mm): Flank Wear Amount | Flank Wear Amount or Top Wear Amount(mm): Top Wear Amount | Impact Number before Breakage (Minimum Number in 10 samples) |
|---|---|---|---|---|
| II-1 | 2 | 0.13 | 0.12 | 4300 |
| II-2 | 3 | 0.12 | 0.13 | 4000 |

TABLE 6-continued

| Sample No. | Peak number in XRD | Flank Wear Amount or Top Wear Amount(mm) Flank Wear Amount | Top Wear Amount | Impact Number before Breakage (Minimum Number in 10 samples) |
|---|---|---|---|---|
| II-3 | 2 | 0.16 | 0.14 | 3600 |
| II-4 | 2 | 0.18 | 0.18 | 3300 |
| II-5 | 2 | 0.13 | 0.12 | 3300 |
| II-6 | 2 | 0.18 | 0.17 | 3500 |
| *II-7 | 1 | 0.22 | 0.20 | 1500 |
| *II-8 | 2 | 0.20 | 0.19 | 2600 |

Sample numbers marked with * are not within the scope of the present invention.

Tables 5 and 6 show that breakage resistance was low in the sample No. II-7 that had only one TiCN layer. In the sample No. II-8 comprising a carbon-rich TiCN layer having C/N ratio of 3, a nitrogen-rich TiCN layer having C/N ratio of 0.45 and an $Al_2O_3$ layer formed in this order from the base body side, the entire TiCN layer peeled off to exposed the base body before the $Al_2O_3$ layer peeled off, resulting in premature peel-off and chipping thus showing performance lower than that of the present invention in continuous cutting as well as intermittent cutting.

In the samples Nos. II-1 through II-6 where the nitrogen-rich TiCN layer having C/N ratio in a range of $0.2 \leqq C/N \leqq 0.7$, the carbon-rich TiCN layer having C/N ratio in a range of $1.5 \leqq C/N \leqq 4$ and the $Al_2O_3$ layer were formed in this order from the base body side, in contrast, long service life was achieved both in continuous cutting and intermittent cutting with stable demonstration of excellent cutting performance in terms of breakage resistance and wear resistance.

EXAMPLE III

A powder mixture constituted from 8.0% by weight of metal cobalt (Co) powder having a mean particle size of 1.2 μm, 0.7% by weight of tantalum carbide (TaC) having a mean particle size of 2.0 μm, 0.6% by weight of titanium carbide, 0.4% by weight of niobium carbide (NbC) and the rest consisting of tungsten carbide (WC) powder having a mean particle size of 1.5 μm was formed in the shape of the cutting tool (CNMA120412) by press molding. After a binder removing treatment was carried out, the green compact was heated at a rate of 3° C./minute above 1000° C. and was fired at 1500° C. in vacuum of 0.01 Pa for one hour so as to fabricate base body made of tungsten carbide-based cemented carbide.

The base body made of tungsten carbide-based cemented carbide thus obtained was coated with hard coating layer by the CVD process to fabricate cutting tools having hard coating layers shown Table 7.

The hard coating layer was formed as follows. A TiN layer among Ti-based layers formed below the $Al_2O_3$ layer and the outermost TiN layer formed above the $Al_2O_3$ layer were grown at a temperature of 1000° C. and pressure of 70 kPa by using a gas mixture constituted from 5% by volume of $TiCl_4$ gas, 45% by volume of $N_2$ gas and the rest consisting of $H_2$ gas.

A TiC layer among the Ti-based layers formed below the $Al_2O_3$ layer was grown in an atmosphere of temperature 1000° C. and pressure of 70 kPa by using a gas mixture constituted from 5% by volume of $TiCl_4$ gas, 0.05% by volume of $CH_4$ gas and the rest consisting of $H_2$ gas.

Of the TiCN layer among the Ti-based layers formed below the $Al_2O_3$ layer, the first layer was grown in an atmosphere of temperature 865° C. and pressure of 9 kPa by using a gas mixture constituted from 1.0% by volume of $TiCl_4$ gas, 40% by volume of $N_2$ gas, 0.05% by volume of $CH_4$ gas, 0.07% by volume of $CH_3CN$ gas and the rest consisting of $H_2$ gas. Then the second layer was grown in an atmosphere of temperature 865° C. and pressure of 9 kPa by using a gas mixture constituted from 1.0% by volume of $TiCl_4$ gas, 40% by volume of $N_2$ gas, 1.0% by volume of $CH_3CN$ gas and the rest consisting of $H_2$ gas.

The $Al_2O_3$ layer was grown in an atmosphere of temperature 1000° C. and pressure of 7 kPa by using a gas mixture constituted from 10% by volume of $AlCl_3$ gas, 1.5% by volume of HCl gas, 1.5% by volume of $CO_2$ gas, 0.01% by volume of $H_2S$ gas and the rest consisting of $H_2$ gas.

In the samples Nos. III-1 through III-5, binding layer was formed by heat treatment under the conditions shown in Table 8 after forming the $Al_2O_3$ layer.

In the sample No. III-6, the Ti-based layer and the $Al_2O_3$ layer were formed without applying heat treatment.

For the sample No. III-7, after the Ti-based layer had been formed, a heat treatment was applied for two hours in a furnace of hydrogen atmosphere at a temperature of 1000° C. and pressure of 20 kPa, and then the $Al_2O_3$ layer was formed.

The thickness of each layer of the surface-coated cutting tool thus fabricated was measured by observing a fracture surface of the hard coating layer with scanning electron microscope model S800 manufactured by Hitachi, Ltd. The composition of the binding layer was measured on the fracture surface by Auger electron spectroscopy analysis (point A in FIG. 4). An example of the analysis is shown in FIG. 6. A ratio of peak intensity of Ti at 400 eV to peak intensity of Al near 1400 eV is shown in Table 7. Denote the peak intensity of Al near 1400 eV, peak intensity of W near 1750 eV and peak intensity of Co near 800 eV measured by Auger electron spectroscopy as $I_{Al}$, $I_W$ and $I_{Co}$, respectively, and the ratio $I_W/I_{Al}$ was calculated and shown in Table 7. The Auger electron spectroscope used in this observation was a scanning FE Auger electron spectroscopy analyzer Model 1680 manufactured by PHI. Crystal structure of the $Al_2O_3$ layer was determined by ordinary X-ray diffraction analysis. The results of these analyses are shown in Table 7. RINT 1100 manufactured by RIGAKU DENKI KOGYO CO., LTD. was used in the X-ray diffraction analysis.

Furthermore, as a result of analyzing concentration of W and Co in the section of the samples by EDS analysis, in samples No. III-1 to III-5, W and Co concentrations were high near the outer surface of the base body, and W and Co concentrations of the bonding layer were twice or more as high as those of the TiCN layer and the $Al_2O_3$ layer. On the other hand, in sample No. III-6 and III-7, W and Co were not detected in the hard layer. Moreover, in sample No. III-7 that added heat treatment after forming Ti-based layer, generation of the bonding layer was not observed but W and Co were detected in Ti-based layer.

Cast iron was cut using this cutting tool according to the following conditions, and while observing the edge of a cutting tool, the amount of flank wear was measured. Cutting time when the amount of flank wear reached at 0.2 mm in the cutting test was measured. Furthermore, by cutting the cast iron as cast, the chipping resistance test and the peeling-off resistance test were conducted, and after carrying out 20 corner evaluations, the ratio of the number of corners in which chipping and peeling-off were generated was compared. When it is close to 0, it has good performance, and when it is close to 100, it has bad performance. These results were shown in Table 7.

Workpiece material: Cast iron as cast (FC250)
Cutting tool shape: CNMA120412
Cutting speed: 350 m/min.
Feed rate: 0.4 mm/rev.
Cutting depth: 1.0 mm
Other condition: Aqueous coolant solution used.

(Chipping Resistance Test)
Workpiece material: Cast iron as cast (FC250)
Cutting tool shape: CNMA120412
Cutting speed: 350 m/min.
Feed rate: 0.4 mm/rev.
Cutting depth: 1.0 mm
Other condition: Aqueous coolant solution used.

(Film Peel-Off Resistance Test)
Workpiece material: Cast iron as cast (FC250)
Cutting tool shape: CNMA120412
Cutting speed: 350 m/min.
Feed rate: 0.3 mm/rev.
Cutting depth: 4.0 mm
Other condition: Aqueous coolant solution used.

TABLE 8-continued

| Sample No. | Heat Treatment after forming $Al_2O_3$ Layer: Temperature (° C.) | Pressure (kPa) | Hours (hr.) | Gas |
|---|---|---|---|---|
| *III-6 | None | None | None | None |
| *III-7 | None | None | None | None |

Sample numbers marked with * are not within the scope of the present invention.

As will be apparent from Table 7, the samples Nos. III-1 through III-5 provided with the binding layer that included Al, Ti, W and Co showed good peel-off resistance and good chipping resistance in the cutting test, and demonstrated excellent wear resistance.

The sample No. III-6 that was not provided with the binding layer showed poor performance in terms of wear resistance, peel-off resistance and chipping resistance.

In the sample No. III-7 that was subjected to heat treatment after forming the Ti-based layer, film peel-off, particularly peel-off of the $Al_2O_3$ layer occurred and performance was not satisfactory in terms of both chipping resistance and wear resistance.

TABLE 7

| Sample No. | Ti-based Layer: Thickness (μm): TiN | TiCN1 ($W_1$)[1)] | TiCN2 ($W_2$)[1)] | TiC | Bonding Layer: Contained Elements | Peak Ratio $I_{Co}/I_{Al}$ | Peak Ratio $I_W/I_{Al}$ | Thickness (μm) | Existence of Interrupt | Outer most Layer | Wear Resistance (min) | Chipping Resistance (%) | Peel-off Resistance (%) |
|---|---|---|---|---|---|---|---|---|---|---|---|---|---|
| II-1 | 1 | (0.3)6 | (0.5)4 | — | Al, Ti, W, Co, O | 0.38 | 0.33 | 1 | No | TiN | 18 | 19 | 19 |
| II-2 | — | (0.2)5 | (0.5)5 | — | Al, W, Co, Ti, C | 0.38 | 0.47 | 1.5 | Yes | TiN | 16 | 14 | 24 |
| III-3 | 0.5 | (0.3)7 | (0.6)2 | — | Al, W, Co, O, Ti, C | 0.37 | 0.40 | 2 | Yes | TiN | 20 | 13 | 18 |
| III-4 | 1 | (0.2)6 | (0.4)5 | 1 | Al, W, Co, O, Ti, C | 0.33 | 0.42 | 0.5 | Yes | TiN | 24 | 0 | 0 |
| III-5 | 1 | (0.2)5 | (0.5)4 | — | Al, W, Co, O, Ti, C | 0.50 | 0.25 | 0.7 | No | TiN | 17 | 19 | 14 |
| *III-6 | 0.5 | (0.7)8 | | 2 | — | — | — | — | — | TiN | 9 | 75 | 75 |
| *III-7 | 1 | (0.6)9 | | | — | — | — | — | — | TiN | 10 | 50 | 70 |

Sample numbers marked with * are not within the scope of the present invention.

TABLE 8

| Sample No. | Heat Treatment after forming $Al_2O_3$ Layer: Temperature (° C.) | Pressure (kPa) | Hours (hr.) | Gas |
|---|---|---|---|---|
| III-1 | 850 | 12 | 1 | Hydrogen |
| III-2 | 1100 | 12 | 4 | Hydrogen |
| III-3 | 900 | 1 | 10 | Hydrogen and Nitrogen |
| III-4 | 1000 | 40 | 4 | Hydrogen |
| III-5 | 1050 | 20 | 2 | Hydrogen |

EXAMPLE IV

Cemented carbide was made similarly to Example III. The cemented carbide was subjected to brushing process for tool nose treatment (honing R).

The cemented carbide was coated with various hard coating layers of a multi-layer structure shown in Table 10 under the conditions shown in Table 9 by CVD process to fabricate the surface-coated cutting tools Nos. IV-1 through IV-6.

TABLE 9

| Coating Layer | Mixed Gas Composition (vol. %) | Rate of $CH_3CN$ Gas in Mixed Gas (vol. %) | Temperature (° C.) | Pressure (kPa) |
|---|---|---|---|---|
| TiCN1<c> | $TiCl_4$: 1.0, $N_2$: 40, $H_2$: rest | 1.1 | 865 | 9 |
| TiCN2<c> | $TiCl_4$: 1.0, $N_2$: 40, $H_2$: rest | 1.5 | 865 | 9 |
| TiCN3<c> | $TiCl_4$: 1.0, $N_2$: 40, $H_2$: rest | 1.8 | 865 | 9 |
| TiCN4<c> | $TiCl_4$: 1.0, $N_2$: 40, $H_2$: rest | 1.5 | 900 | 15 |
| TiCN5<c> | $TiCl_4$: 1.0, $N_2$: 40, $H_2$: rest | 1.8 | 1000 | 15 |

TABLE 9-continued

| Coating Layer | Mixed Gas Composition (vol. %) | Rate of $CH_3CN$ Gas in Mixed Gas (vol. %) | Temperature (° C.) | Pressure (kPa) |
|---|---|---|---|---|
| TiCN6<c> | $TiCl_4$: 1.0, $N_2$: 40, $H_2$: rest | Increasing at 1.1–1.8 continuously | 865 | 9 |
| TiCNO | $TiCl_4$: 0.7, $CH_4$: 4, $N_2$,: 5, $CO_2$: 0.01, $H_2$: rest | — | 1010 | 10 |
| Bottom Layer TiN | $TiCl_4$: 0.5, $N_2$: 33, $H_2$: rest | — | 900 | 16 |
| α - $Al_2O_3$ | $AlCl_3$: 15, HCl: 2, $CO_2$: 4, $H_2S$: 0.01, $H_2$: rest | — | 1005 | 6 |
| Surface Layer TiN | $TiCl_4$: 0.5, $N_2$: 44, $H_2$: rest | — | 1010 | 80 |

Scanning electron microscope (SEM) photographs were taken at five points in an arbitrary fracture surface or polished surface including the cross section of the hard coating layer of the cutting tools fabricated as described above, and the structure of the TiCN layer was studied on the photographs. Line A and line B were drawn as shown in FIG. 8 at a height ⅕ of the total thickness of the TiCN layer from the $Al_2O_3$ layer (surface) side and at a height ⅕ of the total thickness of the TiCN layer from the base body side, respectively. Number of grains that crossed each of the line segment was counted and converted to crystal width of titanium carbonitride crystal. Mean value of the crystal widths determined at the five points of the photograph was taken as the mean crystal width ($w_2$, $w_1$).

It was determined whether the TiCN layer had single layer or a multi-layer structure on the metallurgical microscope photograph or SEM photograph and, in the case of a multi-layer structure, thickness $t_u$ and $t_1$ of the upper layer and the lower layer were measured and ratio $t_1/t_u$ was calculated. When the boundary of layers was not clear in the observation of the TiCN layer, the fracture surface was polished to mirror finish and etched with alkaline red prussiate solution (Murakami's reagent: 10% KOH+10% $KaFe(CN)_6$). Then the processed surface was observed with metallurgical microscope or SEM. The results are shown in Table 10.

Cracks in the hard coating layer of the surface-coated cutting tool were studied by observing the abrasion dent generated by Calotest that was conducted under the following conditions using a metallurgical microscope or SEM, so as to measure crack width bi and $b_2$ in the upper structure and lower structure, respectively, of the TiCN layer observed in the abrasion dent of Calotest. The results are shown in Table 10.

Instrument: CSEM-Calotest manufactured by NANOTEC CORPORATION

Steel ball: Spherical steel ball 30 mm in diameter

Diamond Paste ¼MICRON

Cracks were observed after abrading the surface so that diameter of the area of the base body exposed in the abrasion dent was 0.1 to 0.6 times (0.3 to 0.7 mm in this measurement) the diameter of the abrasion dent. Width of the crack was determined as mean value of width $b_1$ of cracks located at positions one fifth of the length of the TiCN layer region of the abrasion dent from the base body side (inside) and as mean value of width $b_2$ of cracks located at positions one fifth of the length of the TiCN layer region of the abrasion dent from the $Al_2O_3$ layer side (outside). The results are shown in Table 10.

Adhesion force of the hard coating layer was measured in scratch test under the conditions described below. The results are shown in Table 10.

Instrument: CSEM-REVETEST manufactured by NANOTEC CORPORATION

Measuring Conditions

Table speed: 0.17 mm/sec.

Loading rate: 100N/min.

Pressure Piece

Conical diamond pressure piece (Diamond contact piece N2-1487 manufactured by Tokyo Diamond Tools Mfg. Co., Ltd.)

Radius of curvature: 0.2 mm

Angle of edge sides: 120°

TABLE 10

| Sample | Bottom | TiCN Layer | | Intermediate | $Al_2O_3$ Layer | Cooling Rate | Crack width(μm) | | | Adhesion Force of $Al_2O_3$ Layer |
|---|---|---|---|---|---|---|---|---|---|---|
| No. | Layer | Lower Layer | Upper Layer | Layer | Thickness | ° C./min | b1 | b2 | b1/b2 | (N) |
| IV-1 | TiN (0.5) | TICN1<c> (5.0)[0.3] | TiCN2<c> (3.0)[0.6] | TiN0 (0.5) | 2 | 28 | 1 | 2 | 0.5 | 44 |
| IV-2 | TiN (0.6) | TiCN1<c> (4.0)[0.3] | TiCN4<c> (4.0)[1.5] | TiCN0 (0.5) | 3 | 22 | <0.5 | 4 | — | 48 |
| IV-3 | TiN (0.7) | TiCN1<c> (6.0)[0.3] | TiCN3<c> (2.0)[0.9] | TiCN0 (0.5) | 2.5 | 20 | <0.5 | 2 | — | 41 |
| IV-4 | TiN (0.6) | TiCN1<c> (6.0)[0.3] | TiCN5<c> (4.0)[1.5] | TiC0 (0.5) | 2 | 15 | 2 | 3 | 0.7 | 46 |
| *IV-5 | TiN (0.8) | TiCN1<c> (8.0)[0.3] | TiCN5<c> (4.0)[1.5] | TiCN0 (0.5) | 4 | 5 | 37 | 0.8 | 0.875 | 20 |

TABLE 10-continued

| Sample No. | Bottom Layer | TiCN Layer Lower Layer | TiCN Layer Upper Layer | Intermediate Layer | $Al_2O_3$ Layer Thickness | Cooling Rate ° C./min | Crack width(μm) b1 | Crack width(μm) b2 | Crack width(μm) b1/b2 | Adhesion Force of $Al_2O_3$ Layer (N) |
|---|---|---|---|---|---|---|---|---|---|---|
| *IV-6 | TiN (0.4) | TiCN2<c> (8.0)[0.6] | TiCN2<c> (3.0)[0.6] | TiCN0 (0.5) | 3 | 29 | 25 | 2.5 | 1 | 33 |

Sample numbers marked with * are not within the scope of the present invention.
( ) represents layer thickness, and
[ ] represents mean crystal width Unit is μm.
TiCN<c> represent columnar TiCN.

Sample No. IV-5 shown in Table 10 was constituted from TiCN layer having gradient structure made under the conditions of TiCN6 shown in Table 9, namely by continuously increasing the proportion of acetonitrile ($CH_3CN$) gas in the gas mixture.

The cutting tools thus fabricated were subjected to continuous cutting test and intermittent cutting test under the following conditions to evaluate the wear resistance and breakage resistance. The results are shown in Table 11.

(Continuous Cutting Test)

Workpiece material: Ductile cast iron sleeve material (FCD700)

Cutting tool shape: CNMA120412

Cutting speed: 250 m/min.

Feed rate: 0.4 mm/rev.

Cutting depth: 2 mm

Cutting time: 20 minutes

Other condition: Aqueous coolant used.

Evaluation: Observation of cutting edge under a microscope to measure the amounts of wear on flank and wear on tip.

(Intermittent Cutting Test)

Workpiece material: Ductile cast iron sleeve material with four grooves (FCD700)

Cutting tool shape: CNMA120412

Cutting speed: 200 m/min.

Feed rate: 0.3 to 0.5 mm/rev.

Cutting depth: 2 mm

Other condition: Aqueous coolant used.

Evaluation: Number of impacts before breakage

Cutting edge that had experienced 1000 impacts was observed under a microscope, to study the situation of peeling of the hard coating layer.

TABLE 11

| Sample No. | Wear Resistance: Wear Amount(mm) Flank Wear | Wear Resistance: Wear Amount(mm) Top Wear | Breakage Resistance Impact Number before Breakage | State of Hard Layer |
|---|---|---|---|---|
| IV-1 | 0.14 | 0.12 | 4500 | Normal |
| IV-2 | 0.18 | 0.15 | 5800 | Normal |
| IV-3 | 0.16 | 0.16 | 6000 | Normal |
| IV-4 | 0.18 | 0.20 | 5000 | Normal |

TABLE 11-continued

| Sample No. | Wear Resistance: Wear Amount(mm) Flank Wear | Wear Resistance: Wear Amount(mm) Top Wear | Breakage Resistance Impact Number before Breakage | State of Hard Layer |
|---|---|---|---|---|
| *IV-5 | 0.32 | 0.29 | 1100 | Minute Chippings |
| *IV-6 | 0.25 | 0.32 | 2500 | Chippings |

Sample numbers marked with * are not within the scope of the present invention.

As shown in Tables 9 through 11, the sample No. IV-5 and IV-6 comprising a single TiCN layer where cracks were distributed uniformly throughout the TiCN layer experienced chipping occurring in the hard coating layer of the cutting edge in the early stage of the cutting operation, and was broken prematurely due to the chipping.

In the sample No. IV-5 that was cooled after film forming down to 700° C. at a rate slower than 10° C./minute, scale of occurrence of cracks was smaller than in the case of the sample No. IV-6 but cracks were distributed uniformly. Minute chippings occurred during the cutting operation and the cutting tool was broken after experiencing 1100 impacts.

In the sample No. IV-6 where the TiCN layer was formed in a two-layer structure under the same film forming conditions, crack width observed in the abrasion dent of Calotest was uniform, and chipping occurred and the cutting tool was broken after experiencing 2500 impacts.

In the samples Nos. IV-1 through IV-4 where crack width in the upper structure (upper layer) of the TiCN layer on the $Al_2O_3$ layer side was made larger than crack width in the lower structure (lower layer) of the TiCN layer on the base body side, in contrast, peel-off of the hard coating layer did not occur and long service life was demonstrated in continuous cutting as well as intermittent cutting, while excellent cutting performance was demonstrated in terms of both breakage resistance and chipping resistance. Both wear resistance and breakage resistance were excellent particularly in the samples Nos. IV-2 through IV-4 where the TiCN layer was formed in a multi-layer structure, and especially so in the samples Nos. IV-2 and IV-3 where cracks in the lower layer were difficult to observe with width of 0.5 μm or less.

EXAMPLE V

Cemented carbide was made similarly to Example III. The cemented carbide that was fabricated was subjected to brushing process for tool nose treatment (honing R).

The cemented carbide was coated with various hard coating layers of a multi-layer structure shown in Table 13 under the conditions shown in Table 12 by CVD process thereby to fabricate the surface-coated cutting tools No. V-1 through V-7.

TABLE 12

| Coating Layer | Mixed Gas Composition (vol. %) | Rate of $CH_3CN$ Gas in Mixed Gas (vol. %) | Temperature (° C.) | Pressure (kPa) |
|---|---|---|---|---|
| TiCN1 | $TiCl_4$: 1.0, $N_2$: 40, $H_2$: rest | 0.2 | 830 | 9 |
| TiCN2 | $TiCl_4$: 1.0, $N_2$: 40, $H_2$: rest | 0.5 | 780 | 9 |
| TiCN3 | $TiCl_4$: 1.0, $N_2$: 40, $H_2$: rest | 2 | 865 | 9 |
| TiCN4 | $TiCl_4$: 1.0, $N_2$: 40, $H_2$: rest | 3.5 | 900 | 15 |
| TiCN5 | $TiCl_4$: 1.0, $N_2$: 40, $H_2$: rest | 4 | 900 | 15 |
| TiCN6 | $TiCl_4$: 1.0, $N_2$: 40, $H_2$: rest | Increasing at 1.1–1.8 continuously | 865 | 9 |
| TiCNO | $TiCl_4$: 0.7, $CH_4$: 4, N2,: 5, $CO_2$: 0.01, $H_2$: rest | — | 1010 | 10 |
| Bottom Layer TiN | $TiCl_4$: 0.5, $N_2$: 33, $H_2$: rest | — | 900 | 16 |
| $\alpha$ - $Al_2O_3$ | $AlCl_3$: 15, HCl: 2, $CO_2$: 4, $H_2S$: 0.01, $H_2$: rest | — | 1005 | 6 |
| Surface Layer TiN | $TiCl_4$: 0.5, $N_2$: 44, $H_2$: rest | — | 1010 | 80 |

Scanning electron microscope (SEM) photographs were taken at five points in an arbitrary fracture surface or polished surface including a cross section of the hard coating layer of the cutting tools fabricated as described above, and the structure of the TiCN layer was studied on the photographs. Line A and line B were drawn as shown in FIG. 8 at a height 1 μm of the total thickness of the titanium carbonitride layer from the base body side and at a height 0.5 μm of the total thickness of the TiCN layer from the $Al_2O_3$ layer (surface) side, respectively. Number of grains that crossed each of the line segments was counted and converted to crystal width of the titanium carbonitride crystal. Mean value of the crystal widths determined at the five points of the photograph was taken as mean crystal width ($w_2$, $w_1$).

It was determined whether the TiCN layer had single layer or a multi-layer structure on the metallurgical microscope photograph or SEM photograph and, in the case of a multi-layer structure, the thickness $t_u$ and $t_1$ of the upper layer and the lower layer were measured and the ratio $t_1/t_u$ was calculated. When the boundary of layers was not clear in the observation of the TiCN layer, the fracture surface was polished to mirror finish and etched with alkaline red prussiate solution (Murakami's reagent: 10% KOH+10% $KaFe(CN)_6$). Then the processed surface was observed with metallurgical microscope or SEM. The results are shown in Table 13.

Cracks in the hard coating layer of the surface-coated cutting tool were studied by observing an abrasion dent generated by Calotest which was conducted similarly to Example IV using a metallurgical microscope or SEM, so as to measure crack width $b_L$ and $b_U$ in the lower structure and upper structure, respectively, of the titanium carbonitride layer observed in the abrasion dent of Calotest. The results are shown in Table 13.

Length $L_U$ in the radial direction of the upper structure and the length $L_L$ in the radial direction of the lower structure ($=L-L_U$) were estimated on the photograph. Width of the crack was determined as the mean value of width b1 of cracks located at positions one fifth of the length of the TiCN layer region of the abrasion dent from the base body side (inside) and as the mean value of width $b_2$ of cracks located in the interface on the aluminum oxide layer side (outside) of the titanium carbonitride layer region of the abrasion dent 7. The results are shown in Table 13.

The titanium carbonitride layer was polished to be thin enough to allow the lower layer to be seen. Observation of the structure with a transmission electron microscope (TEM) showed that the samples Nos. V-1 through V-4 had needle-like crystal having a mean aspect ratio of 2 or higher.

Adhesion force of the hard coating layer was measured in scratch test similarly to Example IV. The results are shown in Table 13.

TABLE 13

| Sample | | TiCN Layer | | Intermediate | $Al_2O_3$ Layer Thickness | Cooling Rate | Crack Length in Radial Direction(μm) | | | Crack width(μm) | | | Adhesion Force of $Al_2O_3$ |
|---|---|---|---|---|---|---|---|---|---|---|---|---|---|
| No. | Bottom Layer | Lower Layer | Upper Layer | Layer | (μm) | ° C./min | $L_0$ | L | $L_0/L$ | b1 | b2 | b1/b2 | Layer(N) |
| V-1 | TiN (0.5) | TiCN1<c> (5.0)[0.3] | TiCN2<c> (3.0)[0.6] | TiNO (0.5) | 2 | 28 | 18 | 273 | 0.066 | <0.5 | 0.5 | 0 | 44 |
| V-2 | TiN (0.6) | TiCN1<c> (4.0)[0.3] | TiCN4<c> (4.0)[1.5] | TiCNO (0.5) | 3 | 22 | 40 | 280 | 0.154 | <0.5 | 2 | 0 | 48 |
| V-3 | TiN (0.7) | TiCN1<c> (6.0)[0.3] | TiCN3<c> (2.0)[0.9] | TiCNO (0.5) | 2.5 | 20 | 15 | 265 | 0.057 | <0.5 | 1 | 0 | 41 |
| V-4 | TiN (0.6) | TiCN1<c> (6.0)[0.3] | TiCN5<c> (4.0)[1.5] | TiCO (0.5) | 2 | 15 | 42 | 245 | 0.146 | 0.6 | 2 | 0.3 | 46 |
| *V-5 | TiN (0.6) | TiCN1<c> (6.0)[0.3] | TiCN5<c> (4.0)[1.5] | TiCNO (0.5) | 4 | 5 | 70 | 243 | 0.224 | 0.7 | 0.7 | 1 | 20 |
| *V-6 | TiN (0.4) | TiCN2<c> (6.0)[0.6] | TiCN2<c> (3.0)[0.6] | TiCNO (0.5) | 3 | 29 | 250 | 56 | 0.817 | 2.5 | 2.5 | 1 | 33 |

TABLE 13-continued

| Sample | | TiCN Layer | | Intermediate | $Al_2O_3$ Layer Thickness | Cooling Rate | Crack Length in Radial Direction(μm) | | | Crack width(μm) | | | Adhesion Force of $Al_2O_3$ |
|---|---|---|---|---|---|---|---|---|---|---|---|---|---|
| No. | Bottom Layer | Lower Layer | Upper Layer | Layer | (μm) | ° C./min | $L_0$ | L | $L_0/L$ | b1 | b2 | b1/b2 | Layer(N) |
| *V-7 | TiN (0.4) | TiCN6<c> (8.0)[0.3~1.3] | | TiNO (0.5) | 3 | 21 | 103 | 257 | 0.4 | 1 | 5 | 0.2 | 42 |

Sample numbers marked with * are not within the scope of the present invention.
( ) represents layer thickness, and
[ ] represents mean crystal width.
Unit is μm.
TiCN<c> represent columnar TiCN.

Sample No. V-5 shown in Table 13 was constituted from titanium carbonitride layer having gradient structure made under the conditions of TiCN6 shown in Table 12, namely by continuously increasing the proportion of acetonitrile ($CH_3CN$) gas in the gas mixture.

The cutting tools were subjected to continuous cutting test and intermittent cutting test similarly to Example IV to evaluate the wear resistance and breakage resistance.

TABLE 14

| Sample | Wear Resistance: Wear Amount(mm) | | Breakage Resistance Impact Number | State of Hard |
|---|---|---|---|---|
| No. | Flank Wear | Top Wear | before Breakage | Layer |
| V-1 | 0.14 | 0.13 | 7000 | Normal |
| V-2 | 0.18 | 0.16 | 6000 | Normal |
| V-3 | 0.13 | 0.12 | 6200 | Normal |
| V-4 | 0.18 | 0.18 | 5800 | Normal |
| *V-5 | 0.33 | 0.27 | 1200 | Minute Chippings |
| *V-6 | 0.31 | 0.26 | 1800 | Chippings |
| *V-7 | 0.23 | 0.21 | 4100 | Normal |

Sample numbers marked with * are not within the scope of the present invention.

As can be seen from Tables 12 through 14, in the sample No. V-5 that was cooled after film forming down to 700° C. at a rate slower than 10° C./minute, ratio $L_U/L$ of length $L_U$ in the radial direction of the upper structure on the aluminum oxide layer side to the length L in the radial direction of the entire titanium carbonitride layer ($L=L_U+L_L$, where $L_L$ is length in the radial direction of the lower structure) exceeded 0.15, while microscopic chippings occurred during the cutting operation, and the cutting tool was broken after 1200 impacts.

In sample No. V-6 where the titanium carbonitride layer was formed in a two-layer structure under the same film forming conditions and in sample No. V-7 fabricated by changing the film forming condition continuously, proportion of cracks occurring in the upper structure of the TiCN layer ($L_U/L$) observed in the abrasion dent of Calotest exceeded 0.15. In these cases, too, chippings occurred and the cutting tools were broken after machining 1800 workpieces and 4100 workpieces.

In samples Nos. V-1 through V-4 where crack width in the upper structure (upper layer) of the titanium carbonitride layer on the aluminum oxide layer side was made larger than crack width in the lower structure (lower layer) of the titanium carbonitride layer on the base body side, and proportion of cracks occurring in the upper structure ($L_U/L$) was in a range from 0.05 to 0.15, in contrast, peel-off of the hard coating layer did not occur and long service life was demonstrated in continuous cutting as well as intermittent cutting, while excellent cutting performance was demonstrated in terms of both breakage resistance and chipping resistance. Both wear resistance and breakage resistance were excellent particularly in samples Nos. V-1 through V-4 where the titanium carbonitride layer was formed in a multi-layer structure, and especially so in samples Nos. V-1 through V-3 where cracks in the lower layer were difficult to observe with width of less than 0.5 μm.

EXAMPLE VI

Cemented carbide was made similarly to Example II. The cemented carbide was then subjected to brushing process for tool nose treatment (honing R).

The cemented carbide was coated with various hard coating layers of a multi-layer structure shown in Table 16 under the conditions shown in Table 15 by CVD process thereby to fabricate sample Nos. VI-1 through VI-6 of the surface-coated cutting tool.

TABLE 15

| Coating Layer | Mixed Gas Composition (vol. %) | Rate of $CH_3CN$ Gas in Mixed Gas (vol. %) | Temperature (° C.) | Pressure (kPa ) |
|---|---|---|---|---|
| TiCN1 | $TiCl_4$: 1.0, $N_2$: 40, $H_2$: rest | 0.2 | 830 | 9 |
| TiCN2 | $TiCl_4$: 1.0, $N_2$: 40, $H_2$: rest | 0.5 | 780 | 9 |
| TiCN3 | $TiCl_4$: 1.0, $N_2$: 40, $H_2$: rest | 2 | 865 | 9 |
| TiCN4 | $TiCl_4$: 1.0, $N_2$: 40, $H_2$: rest | 3.5 | 900 | 15 |
| TiCN5 | $TiCl_4$: 1.0, $N_2$: 40, $H_2$: rest | 4 | 900 | 15 |
| TiCNO | $TiCl_4$: 0.7, $CH_4$: 4, $N_2$,: 5, $CO_2$: 0.01, $H_2$: rest | — | 1010 | 10 |
| Bottom Layer TiN | $TiCl_4$: 0.5, $N_2$: 33, $H_2$: rest | — | 900 | 16 |

TABLE 15-continued

| Coating Layer | Mixed Gas Composition (vol. %) | Rate of $CH_3CN$ Gas in Mixed Gas (vol. %) | Temperature (° C.) | Pressure (kPa ) |
|---|---|---|---|---|
| α - $Al_2O_3$ | $AlCl_3$: 15, HCl: 2, $CO_2$: 4, $H_2S$: 0.01, $H_2$: rest | — | 1005 | 6 |
| Surface Layer TiN | $TiCl_4$: 0.5, $N_2$: 44, $H_2$: rest | — | 1010 | 80 |

The cutting tools thus fabricated were polished so as to allow observation of the structure of the hard coating layer shown in Table 16 by using a transmission electron microscope (TEM) and identify the structure of the titanium carbonitride grains on the surface, thereby to measure the mean aspect ratio. Scanning electron microscope (SEM) photographs were taken at five points in an arbitrary fracture surface including a cross section of the hard coating layer, so as to observe the structure of the titanium carbonitride layer on the photographs, and measure the mean aspect ratio in the direction of cross section and the mean crystal width w of the titanium carbonitride grains. At this time, line A and line B were drawn as shown in FIG. 8 at a height 1 μm of the total thickness of the titanium carbonitride layer from the base body side for the lower layer, and at a height 0.5 μm from the surface side for the upper layer, respectively. Number of grains that crossed the line segment was counted and converted to crystal width of a stringer-like TiCN crystal. Mean value of the crystal widths determined at the five points of the photograph was taken as the mean crystal width.

Cracks in the hard coating layer of the surface-coated cutting tool were studied by observing an abrasion dent generated by Calotest which was conducted similarly to Example IV using a metallurgical microscope or SEM, so as to measure crack width $b_L$ and $b_U$ in the lower structure and upper structure of the titanium carbonitride layer observed in the abrasion dent of Calotest. The results are shown in Table 16.

Width of crack was determined as the mean value of width b, of cracks located at positions one fifth of the length of the titanium carbonitride layer region of the abrasion dent from the base body side (inside) and as the mean value of width $b_2$ of cracks located at positions one fifth of the length of the TiCN layer region of the abrasion dent from the aluminum oxide layer side (outside). The results are shown in Table 16.

The adhesion force between the $Al_2O_3$ layer and the TiCN layer was measured in scratch test similarly to Example IV. The results are shown in Table 16.

Instrument: CSEM-REVETEST manufactured by NANO-TEC CORPORATION

Measuring Conditions

Table speed: 0.17 mm/sec.

Loading rate: 100N/min.

Pressure Piece

Conical diamond pressure piece (Diamond contact piece N2-1487 manufactured by Tokyo Diamond Tools Mfg. Co., Ltd.)

Radius of curvature: 0.2 mm

Angle of edge sides: 120°

TABLE 16

| Sample No. | Bottom Layer | TiCN Layer | | Intermediate Layer | $Al_2O_3$ Layer Thickness (μm) | Observation of TiCN Particles in Cross Section Direction: Stracture | Aspect Ratio | Observation of TiCN Particles in Surface Direction: Stracture | Aspect Ratio | Crack width(μm) b1 | b2 | Adhesion Force of $Al_2O_3$ Layer(N) |
|---|---|---|---|---|---|---|---|---|---|---|---|---|
| VI-1 | TiN (0.5) | TiCN1<c> (5.0)[0.3] | TiCN2<c> (3.0)[0.6] | TiNO (0.5) | 2 | Stringer | 13 | Needle-like | 5 | <0.5 | 0.5 | 44 |
| VI-2 | TiN (0.6) | TiCN2 (4.0)[0.1] | TiCN4 (4.0)[1.5] | TiCNO (0.5) | 3 | Stringer | 12 | Needle-like | 10 | <0.5 | 2 | 48 |
| VI-3 | TiN (0.7) | TiCN1 (6.0)[0.3] | TiCN3 (2.0)[0.9] | TiCNC (0.5) | 2.5 | Stringer | 20 | Needle-like | 8 | <0.5 | 1 | 41 |
| VI-4 | TiN (0.6) | TiCN1<c> (6.0)[0.3] | TiCN5<c> (4.0)[1.5] | TiCO (0.5) | 2 | Stringer | 8 | Needle-like | 3 | 0.6 | 2 | 46 |
| *VI-5 | TiN (0.6) | TiCN5 (6.0)[0.6] | | TiCNO (0.5) | 4 | Stringer | 8 | Isotropic | 1.2 | 0.7 | 0.8 | 20 |
| *VI-6 | TiN (0.4) | TiCN3 (6.0)[0.8] | TiCN5 (3.0)[1.2] | TiCNO (0.5) | 3 | Stringer | 6 | Isotropic | 1.5 | 2.5 | 2.5 | 38 |

Sample numbers marked with * are not within the scope of the present invention
( ) represents layer thickness, and
[ ]represents mean crystal width.
Unit is μm.

The cutting tools were subjected to intermittent cutting test under the following conditions to evaluate the breakage resistance and chipping resistance.

(Cutting Conditions)

Workpiece material: Ductile cast iron sleeve material with four grooves (FCD700)

Cutting tool shape: CNMA120412

Cutting speed: 200 m/min.

Feed rate: 0.3 to 0.5 mm/rev.

Cutting depth: 2 mm

Other condition: Aqueous coolant used.

Evaluation: Number of impacts before breaking

Cutting edge that had experienced 1000 impacts was observed under a microscope, to study the situation of peeling of the hard coating layer.

TABLE 8

| Sample No. | Heat Treatment after forming $Al_2O_3$ Layer | | | |
|---|---|---|---|---|
| | Temperature (° C.) | Pressure (kPa) | Hours (hr.) | Gas |
| III-1 | 850 | 12 | 1 | Hydrogen |
| III-2 | 1100 | 12 | 4 | Hydrogen |
| III-3 | 900 | 1 | 10 | Hydrogen and Nitrogen |
| III-4 | 1000 | 40 | 4 | Hydrogen |
| III-5 | 1050 | 20 | 2 | Hydrogen |
| *III-6 | None | None | None | None |
| *III-7 | None | None | None | None |

Sample numbers marked with * are not within the scope of the present invention.

Tables 15 through 17 show that, in samples Nos. VI-5 and VI-6 where 0.4% by volume of $CH_3CN$ was included in the gas mixture and observation of the surface of the titanium carbonitride grains showed isotropic structure instead of needle-like structure, strength of the hard coating layer was insufficient and chipping occurred in the hard coating layer of the cutting edge in the early stage of cutting operation with the cutting tool being broken prematurely due to the chipping.

In any of the samples Nos. VI-1 through VI-4 where the titanium carbonitride grains showed needle-like structure when observed on the surface and showed stringer structure when observed on the vertical cross section, the hard coating layer did not peel off and excellent cutting performance was obtained in terms of both breakage resistance and chipping resistance, showing long service life in both continuous cutting and intermittent cutting.

What is claimed is:

1. The A surface-coated member comprising the following (1a) through (1c):

(1a) the surface-coated member comprising a base body, and a hard coating layer comprising at least a TiCN layer and an $Al_2O_3$ layer formed in this order on the surface of the base body;

(1b) said TiCN layer comprising TiCN crystal that is grown in a direction perpendicular to said base body; and (1c) said TiCN crystal comprising at least two layers wherein the mean crystal width thereof is larger on the $Al_2O_3$ layer side than on said base body side, wherein said TiCN layer comprises a carbon-rich TiCN layer located on top of said $Al_2O_3$ layer side where the ratio C/N of proportions of carbon C and nitrogen N is in a range of $1.5 \leqq C/N \leqq 4$, and a nitrogen-rich TiCN layer located below the carbon-rich TiCN layer where the ratio C/N is in a range of $0.2 \leqq C/N \leqq 0.7$.

2. The surface-coated member according to claim 1, wherein the mean crystal width of the TiCN crystal on the $Al_2O_3$ layer side is from 0.2 to 1.5 μm.

3. The surface-coated member according to claim 1, wherein the mean crystal width of the TiCN crystal on the base body side is 0.7 times or less as the mean crystal width $w_2$ on the $Al_2O_3$ layer aide.

4. The surface-coated member according to claim 1, wherein at least one layer comprising a material selected from a group consisting of TiN, TiCN, TiC, TiCNO, TiCO and TiNO is interposed between the layers of said TiCN layer comprising at least two layers.

5. The surface-coated member according to claim 1, wherein said $Al_2O_3$ layer has an a type crystal structure.

6. The surface-coated member according to claim 1, wherein a ratio $t_C/t_N$ of the thickness $t_C$ of the carbon-rich TiCN layer to the thickness $t_N$ of the nitrogen-rich TiCN layer is in a range from 0.8 to 1.2.

7. The surface-coated member according to claim 1, wherein such a binding layer that comprises mainly of at least titanium (Ti), aluminum (Al), tungsten (W) and cobalt (Co) is formed between said TiCN layer and said $Al_2O_3$ layer.

8. The surface-coated member according to claim 7, wherein said binding layer is formed through diffusion of elements from one or more of said base body, said TiCN layer and said $Al_2O_3$ layer.

9. The surface-coated member according to claim 7, wherein said binding layer has intermittent structure and, when it is assumed that the binding layer had continuous and uniform structure, mean thickness of said binding layer is from 0.05 to 4 μm.

10. The surface-coated member according to claim 7, wherein peak intensity $I_{Al}$ of Al near 1400 eV, peak intensity $I_w$, of W near 1750 eV and peak intensity $I_{Co}$ of Co near 800 eV in the observation data of said binding layer with Auger electron spectroscopy are in such relations that the ratio $I_w/I_{Al}$ is in a range from 0.1 to 0.5 and ratio $I_{Co}/I_{Al}$ is in the range from 0.1 to 0.5.

11. The surface-coated member according to claim 7, wherein concentrations of W and Co in the base body comprising hard alloy are higher on the surface than inside of the base body.

12. The surface-coated member according to claim 7, wherein concentrations of W and Co in said binding layer are twice or more higher than the concentrations of W and Co in said TiCN layer and said $Al_2O_3$ layer.

13. The surface-coated member according to claim 7, wherein the adhesion force of said $Al_2O_3$ layer is 10 to 50 N in Scratch examination.

14. The surface-coated member according to claim 7, which is a cutting tool used for machining a workpiece by bringing a cutting edge thereof into contact with the workpiece.

15. The surface-coated member according to claim 7, which is a cutting tool used for machining a workpiece by bringing a cutting edge thereof into contact with the workpiece.

16. A surface-coated member comprising the following (2a) and (2b):

(2a) the surface-coated member comprises a base body and a hard coating layer made of at least a TiCN layer and an $Al_2O_3$ layer formed on the surface of the base body in this order; and (2b) a TiCN layer, that is observed on the periphery of the base body exposed at the center of an abrasion dent on the surface in Calotest, includes a lower structure where crack width is small or zero, and an upper structure where crack width is larger than that of the lower structure, observed on the periphery of said lower structure, wherein said TiCN layer comprises at least two layers of a lower TiCN layer where crack width is zero or small observed on the periphery of the base body that is exposed at the center of said abrasion dent and an upper TiCN layer where crack width is larger than that of said lower TiCN layer observed on the periphery of said lower TiCN layer, wherein, when the composition of the TiCN layer is expressed as $Ti(C_{1-x}N_x)$, a value of x is in a range from 0.55 to 0.80 in said lower TiCN layer and in a range front 0.40 to 0.55 in said upper TiCN layer.

17. The surface-coated member according to claim 16, wherein the width of crack observed in the lower structure of said TiCN layer is ½ or smaller as width of crack observed in the upper structure.

18. The surface-coated member according to claim 16, wherein the thickness $t_1$ of said lower TiCN layer is in a range of 1 μm≦$t_1$≦10 μm, and the thickness of said upper TiCN layer is in a range of 0.5 μm≦$t_\mu$≦5 μm, while two values of thickness satisfy an inequality $1 \leqq t_1/t_\mu \leqq 5$.

19. The surface-coated member according to claim 16, wherein said TiCN layer comprises TiCN grains having a stringer structure extending at right angles to the surface of said base body while mean crystal width of the TiCN grains that constitute said upper TiCN layer is larger than the mean crystal width of the TiCN grains that constitute said lower TiCN layer.

20. The surface-coated member according to claim 19, wherein the mean crystal width $w_1$ in the upper layer of said TiCN layer is from 0.2 to 1.5 μm and the mean crystal width $w_2$ in said lower TiCN layer is 0.7 times or less as the mean crystal width $w_1$ in said upper TiCN layer.

21. The surface-coated member according to claim 16, wherein the adhesion force of said $Al_2O_3$ layer is from 10 to 50N as measured in scratch examination.

22. The surface-coated member according to claim 16, wherein observation of an abrasion dent in Calotest shows cracks existing in a region from the interface of said $Al_2O_3$ layer with said TiCN layer to the inside of the $Al_2O_3$ layer.

23. The A surface-coated member comprising the following (3a) and (3b):

(3a) the surface-coated member comprises a base body and a hard coating layer comprising at least one TiCN layer formed on the surface of the base body;

(3b) said TiCN layer has, at least in a part thereof, titanium carbonitride grains extend in a direction perpendicular to the surface of said base body and shows a stringer structure when vertical cross section is observed; and (3c) said TiCN lava includes a fine pained titanium carbonitride layer that shows a needle-like structure extending in random directions when observed on the surface, wherein the surface of said fine rain titanium carbonitride layer is coated with an upper titanium carbonitride layer of which titanium carbonitride grains have a larger mean crystal width than that in said fine grain titanium carbonitride layer, and surface of said upper titanium carbonitride layer is coated with an aluminum oxide layer, wherein the thickness $t_1$ of said fine grain titanium carbonitride layer is in a range of 1 μm≦$t_1$≦10 μm and the thickness $t_\mu$of said upper titanium carbonitride layer is in a range of 0.5 μm<$t_\mu$≦5 μm while two values of thickness satisfy an inequality $1 \leqq t_1/t_\mu \leqq 5$.

24. The surface-coated member according to claim 23, wherein a TiCN layer, that is observed on the periphery of the base body exposed at the center of an abrasion dent on the surface in Calotest, includes a lower structure where crack width is small or zero, and an upper structure where crack width is larger than that of the lower structure, observed on the periphery of said lower structure, and a ratio $L_U/L$ of the length $L_u$ in the radial direction of said upper structure to the Length L in the radial direction of the entire TiCN layer ($L=L_U+L_L$, where $L_L$ is length in the radial direction of said lower structure) is in a range from 0.05 to 0.15.

25. The surface-coated member according to claim 23, wherein the titanium carbonitride grains have a mean aspect ratio of 2 or higher when the crystal grains are observed from the surface.

26. The surface-coated member according to claim 23, wherein the mean length of long axis of said titanium carbonitride grains is 1 μm or less when said titanium carbonitride grains are observed from the direction of surface.

27. The surface-coated member according to claim 23, wherein the adhesion force of said $Al_2O_3$ layer is 10 to 50 N in Scratch examination.

28. The surface-coated member according to claim 23, which is a cutting tool used for machining a workpiece by bringing a cutting edge thereof into contact with the workpiece.

* * * * *